US007204952B1

(12) United States Patent
Poor et al.

(10) Patent No.: US 7,204,952 B1
(45) Date of Patent: Apr. 17, 2007

(54) VACUUM FURNACE FOR CARBURIZING WITH HYDROCARBONS

(75) Inventors: Ralph P. Poor, Toledo, OH (US); Gary W. Barbee, Rossford, OH (US); Stephen H. Verhoff, Monclova, OH (US); James E. Brug, Toledo, OH (US)

(73) Assignee: Surface Combustion, Inc., Maumee, OH (US)

( * ) Notice: Subject to any disclaimer, the term of this patent is extended or adjusted under 35 U.S.C. 154(b) by 0 days.

(21) Appl. No.: 11/263,551

(22) Filed: Oct. 31, 2005

Related U.S. Application Data

(62) Division of application No. 10/205,699, filed on Jul. 26, 2002, now Pat. No. 6,991,687.

(60) Provisional application No. 60/308,454, filed on Jul. 27, 2001, provisional application No. 60/308,452, filed on Jul. 27, 2001.

(51) Int. Cl.
*C21B 7/24* (2006.01)

(52) U.S. Cl. ..... 266/81; 266/252

(58) Field of Classification Search ..... 266/252, 266/81

See application file for complete search history.

(56) References Cited

U.S. PATENT DOCUMENTS

| | | | | |
|---|---|---|---|---|
| 2,348,557 | A | | 5/1944 | Mattox |
| 2,915,571 | A | | 12/1959 | Haensel |
| 3,529,152 | A | | 9/1970 | Strange et al. |
| 3,917,238 | A | | 11/1975 | Gohring |
| 3,968,957 | A | | 7/1976 | Asai et al. |
| 4,008,394 | A | | 2/1977 | Risgin et al. |
| 4,030,712 | A | * | 6/1977 | Rogers ..... 266/252 |
| 4,166,610 | A | | 9/1979 | Yamazaki et al. |
| 4,191,598 | A | | 3/1980 | Conybear et al. |
| 4,232,852 | A | | 11/1980 | Limque et al. |
| 4,249,965 | A | | 2/1981 | Schultz |
| 4,386,973 | A | | 6/1983 | Kawka et al. |
| 4,783,575 | A | | 11/1988 | Schmidt et al. |
| 5,093,571 | A | | 3/1992 | Inomata et al. |
| 5,127,967 | A | | 7/1992 | Verhoff et al. |
| 5,205,873 | A | | 4/1993 | Faure et al. |
| 5,224,857 | A | | 7/1993 | Schultz et al. |

(Continued)

OTHER PUBLICATIONS

A.J. Derosset and C.V. Berger, "Thermal and catalytic Decomposition of Hydrocarbons," Universal Oil Products Co. Des Planes, IL, an I/EC Unit Process Review, Industrial and Engineering chemistry, vol. 53, No. 8, Aug. 1961, pp. 680-682.

(Continued)

*Primary Examiner*—Scott Kastler
(74) *Attorney, Agent, or Firm*—MacMillan, Sobanski & Todd, LLC

(57) ABSTRACT

Vacuum carburizing of ferrous workpieces is performed at low pressure in a vacuum furnace using a carburizing hydrocarbon as the carburizing medium. The furnace is constructed to be generally transparent to the carburizing hydrocarbon so that cracking tends to occur at the workpiece which functions as a catalyst to minimize carbon deposits. The carburizing hydrocarbon is supplied in liquid form to an injector which injects the liquid carburizing hydrocarbon as a vapor to produce a uniform dispersion of the carburizing hydrocarbon about the workpiece, resulting in uniform carburizing of the workpieces.

45 Claims, 11 Drawing Sheets

U.S. PATENT DOCUMENTS

| | | | |
|---|---|---|---|
| 5,228,850 | A | 7/1993 | Hoetzl et al. |
| 5,528,032 | A | 6/1996 | Uchiyama |
| 5,593,571 | A | 1/1997 | Heyse et al. |
| 5,702,540 | A | 12/1997 | Kubota |
| 6,187,111 | B1 | 2/2001 | Waka et al. |
| 6,237,575 | B1 | 5/2001 | Lampert et al. |
| 6,258,179 | B1 | 7/2001 | Takayama et al. |
| 6,283,749 | B1 | 9/2001 | Bernard, Jr. et al. |
| 6,366,355 | B1 | 4/2002 | deGroot et al. |
| 2003/0020214 | A1 | 1/2003 | Poor et al. |

OTHER PUBLICATIONS

Michael Lohrmann and Winfried Grafen, Ipsen International GmbH, Kleve, Germany, "New Wrinkles in Low-Pressure Carburizing", Heat Treating Progress, Feb./Mar. 2001, pp. 47-51.

Piotr Kula, Institute of Material Science & Engineering, Josef Olejnik, Seco/Warwick (Poland) Ltd. Janusz Kowalski, Seco/Warwick Corp."New Vacuum Carburizing Technology," Heat Treating Progress, Feb./Mar. 2001 pp. 57-60.

* cited by examiner

VACUUM FURNACE FOR CARBURIZING WITH HYDROCARBONS

CROSS REFERENCE TO PATENT APPLICATION UNDER 35 USC §119

This application is a divisional application of U.S. Ser. No. 10/205,699 filed Jul. 26, 2002 now U.S. Pat. No. 6,991,687 which claims the benefit of U.S. Provisional Application No. 60/308,454, filed Jul. 27, 2001, entitled "Vacuum Carburizing by Saturated Aromatic Hydrocarbons", which is expressly incorporated herein by reference. This application also claims the benefit of U.S. Provisional Application No. 60/308,452, filed Jul. 27, 2001, entitled "Vacuum Carburizing by Unsaturated Aromatic Hydrocarbons", which is expressly incorporated herein by reference.

This invention relates generally to method and apparatus for carburizing ferrous workpieces, and more particularly to method and apparatus for vacuum carburizing ferrous workpieces.

BACKGROUND

This invention (method and apparatus) relates to carburizing ferrous articles, parts or workpieces and conceptually related processes such as carbonitriding. Carburizing may be defined as the introduction or application of additional carbon to the surface of a ferrous metal article with the object of increasing the carbon content of the surface, and to some limited depth, beneath the surface (the depth of substantive penetration of the carbon hereinafter called "case") of the article. When the article is subsequently subjected to an additional heat treatment, the surface portion carburizes resulting in a substantially harder surface than the underlying virgin or "green" metal. This is known in the art as "hardening."

Carburizing is an old and developed process. There are a number of methodologies which have been used to carburize ferrous parts. Perhaps the earliest application is "box carburizing" where open charcoal pits were used. Bone meal was packed around the parts to provide a protective atmosphere when heated and to be the source of carbon. That process has evolved into "pack carburizing" where parts to be carburized are packed into a box with a carburizing compound, such as metal carbonates burned to a hardwood charcoal by the use of oil, tar and the like, packed thereabout. Carbon is formed on the surface of the steel by the decomposition of carbon monoxide (from the carburizing compound) into carbon and carbon dioxide. The carbon dioxide that is formed reacts immediately with the uncondensed carbon in the carburizing compound to produce fresh carbon monoxide. This process is repeated as long as there is enough carbon present to react with the excess of carbon dioxide and until the surface of the ferrous part is saturated. This "class" of carburizing is distinguished from the prior art to which this invention relates by its requirement for a solid carburizing compound "packed" about the workpiece. Another process which is used is liquid carburizing in which the steel or iron is placed in a molten salt bath that contains chemicals such as barium cyanide and the like required to produce a chafe comparable with one resulting from pack carburizing. The piece is placed in the bath for a predetermined length of time at elevated temperature such that the carbon diffuses into the surface of the metal. This "class" of carburizing is distinguished from the prior art to which this invention relates by its requirement for a liquid or salt bath into which the workpiece is submerged.

This invention generally relates to carburizing by "gas" in that a gas containing carbon is used as a gaseous medium to provide gas phase carbon atoms to iron to produce the face centered iron with carbon in the matrix as well as iron carbide ($Fe_3C$) precipitate. Gas carburizing can be further divided into atmosphere gas carburizing and vacuum carburizing with vacuum ion carburizing as a separate species of vacuum carburizing.

Atmosphere gas carburizing is a well developed technology which has proven acceptable for most case hardening carburizing applications. In atmosphere gas carburizing, a hydrocarbon typically natural gas (methane), propane or butane, is metered into an endothermic gas furnace atmosphere maintained-at positive pressure (i.e., at "atmospheric" pressure) in an industrial furnace. By controlling dew point of the gas composition (endothermic gas and carburizing gas), most typically the $CO/CO_2$ gas ratio (water gas shift reaction), the gas carbon potential is controlled. Typically, the gas carbon potential is set at or near the saturation of carbon in the iron solution and when carbon in the iron matrix and iron carbide ($Fe_3C$) precipitates are formed throughout the surface, the gas carbon potential of the furnace atmosphere gas is changed to neutral ("equilibrium carburizing") to allow the carbon to diffuse into the case. The diffusion can be controlled vis-a-vis gas composition and temperature. For example, it is possible with atmosphere gas carburizing to actually decarb (remove carbon from) the surface during diffusion to allow a harder part composition between part surface and "green" core (portion of virgin metal beneath surface not affected by carburizing) because the case depth is increasing during diffusion. Further, in atmosphere gas carburizing the carbon potential does not have to be set at saturation limits of the steel. Specifically the carbon potential can be set at lesser values to avoid a natural phenomenon occurring at saturation referred to herein as "carbide network". That is, at saturation, the surface of the part comprises iron carbides closely packed as adjacent molecules of face centered carbon steel which can be viewed as linked together in a "carbide network." When carbon diffusion occurs it is potentially possible that groups or clusters of the packed iron carbide molecules are not homogeneous throughout the case. Conventional metallurgical thinking in the trade is that over time and at high stress, the carbide network can function as a stress riser. Some metallurgists, however, do not share this opinion.

With atmosphere gas carburizing, the carbide network can be minimized by simply controlling the carbon potential to minimize the formation of the network in the first place. That is, if carburizing does not occur at saturation, the network is not likely to be formed. Atmosphere gas carburizing inherently produces metal oxides on the part surface because of the presence of oxygen in the atmosphere. For this reason, atmosphere gas carburizing is fundamentally different from vacuum gas carburizing which does not have oxygen. For this reason as well as other process considerations fundamentally arising from the use of vacuum and its affect on gas reactions, atmosphere gas carburizing is a carburizing class distinguishable from the prior art related to this invention. (Also, this invention is fundamentally different from vacuum carburizing prior art which uses oxygen. For example, see U.S. Pat. No. 4,386,973 to Kawka et al., issued Jun. 7, 1983, which discloses alcohol for use as a vacuum carburizing gas.) For closely controlled, high stress areas such as required in-the aerospace industries and even forgear trains in vehicular applications, the presence of metal oxides which, among other things, produce stress risers and change part dimensions is not acceptable.

Vacuum carburizing avoids the formation of metal oxides because a hydrocarbon gas lacking oxygen is used and the furnace chamber is pumped down to a high vacuum (low pressure) to remove any oxygen that may be present. Vacuum furnaces are typically utilized for heat treating precision parts with strict case hardening specifications. In vacuum carburizing the furnace is pumped down to a vacuum and the part heated to a carburizing temperature under vacuum. The furnace is then backfilled (but still under vacuum) with a carburizing gas, typically propane or butane, which disassociates at the carburizing temperature to produce carbon molecules that go into solution with the iron and cause iron carbide as precipitate at the part surface. Because the carbon disassociation can not be controlled (the presence of vacuum and only the carburizing gas), vacuum carburizing proceeds at saturation limits (about 1.31% for carburizing plain carbon type steels at temperatures of 1700° F.) and produces the carbide network discussed above throughout the surface. (If the carburizing hydrocarbon gas is metered at less than carbon saturation potential, uneven carburizing occurs.) Often the saturation portion of the carburizing cycle is called the "boost" portion. Metering of the carburizing gas is stopped at this point and diffusion is allowed to proceed with or without a change in temperature. (If the vacuum pump continues to run after metering of the gas is stopped, the vacuum increases and the part is subjected to strictly diffusion. As used herein, "diffusion" covers both "boost diffusion" and diffusion at a fixed or set vacuum level).

Again, it must be noted that many metallurgists believe that vacuum diffusion (Fickes Law, Harris Law) disassociates or breaks up the iron carbide network. Others believe that the network can exist as described above. Still others believe the iron carbide network is not undesirable. Iii any event, carbon in solution diffuses into the case when flow of carburizing gas stops and vacuum is maintained at the carburizing temperature. The cycle may be repeated until the proper depth of carbon penetration is obtained. The carburized part is subsequently either heated to a proper hardening temperature and transferred to a quench (either a gas quench at high, bar or a liquid quench which can be either under vacuum or positive pressure in the furnace) or removed from the furnace and later reheated and case hardened. Typically, the vacuum furnace is a cold wall, water cooled pressure vessel heated by electric heating elements. Recent developments in this area have included the use of gas fired radiant tubes to replace the electric resistance heating elements (see U.S. Pat. No. 5,224,857 to Schultz et al., issued Jul. 6, 1993) and the development of gas fired, hot wall vacuum carburizing furnaces (see U.S. Pat. No. 5,228,850 to Hoetzl et al., issued Jul. 20, 1993 and U.S. Pat. No. 6,283,749 to Bernard et al., issued Sep. 4, 2001). Because of the hot wall configuration, the temperature for hardening applications may be limited in hot wall carburizing furnaces, but carburizing temperatures of 17000 F are obtainable. Some limitations present in conventional vacuum furnaces relate to the ability to uniformly carburize parts having convoluted surfaces such as certain types of gears or certain parts which may be tightly packed in work baskets hindering penetration of the carburizing gases. In such applications an ion carburizing furnace has been developed which develops a cold plasma that produces a glow about the workpiece (see, for example, U.S. Pat. No. 5,127,967 to Verhoff et al., issued Jul. 7, 1992). The carburizing gas is ionized in the glow discharge producing carbon. Typically, the parts are initially cleansed by ionizing a non-carbon bearing gas, such as hydrogen, in a "sputter clean" step. During carburizing, the glow discharge produces a uniform infusion of carbon over the irregular part surface. Like conventional vacuum carburizing, vacuum ion carburizing also has iron carbide network limitations since carbon diffuses into the surface until saturation. In addition a conventional vacuum furnace has to be fitted with a power supply and electrically insulated vis-a-vis its hearth so that gas ionization can proceed. This increases the expense of the furnace.

This invention relates to gas carburizing with vacuum and prior art classified as conventional vacuum carburizing or vacuum ion carburizing is pertinent to the present invention.

Typically, the carburizing gas used in vacuum carburizing is a lower order saturated aliphatic hydrocarbon such as propane or butane while gas atmosphere carburizing typically uses the simplest alkane, methane. However, other carburizing gases have been used in vacuum carburizing. U.S. Pat. No. 5,702,540 to Kubota, issued Dec. 30, 1997, is commercialized and discloses the use of acetylene as a carburizing gas. The gas has been promoted for its ability to achieve carbon diffusion in small holes having high L/D (hole length to hole diameter) ratios when compared to processes using the typical straight chain alkanes. Because of the sooting (carbon deposit) produced by acetylene, Kubota operates the furnace chamber at high vacuum (low pressure). The concept is to draw the carburizing gas out quickly so carbon cannot deposit while the abundant supply of carbon present in the acetylene gas is still sufficient to form a saturated iron carbide at the surface of the workpiece. Thus, Kubota uses an unsaturated aliphatic gas at high vacuum (low pressure) to prevent sooting. In contrast, U.S. Pat. No. 6,187,111 to Waka et al., issued Feb. 13, 2001, uses ethylene as a carburizing gas but at a lower vacuum level (higher pressure) than Kubota. According to Waka, if the vacuum is higher (low pressure) than the minimum, carburizing cannot occur and if the vacuum is lower (less pressure) than the maximum, carbon soot will form. U.S. Pat. No. 5,205,873 to Faure et al., issued Apr. 27, 1993, also discloses the use of the unsaturated aliphatic hydrocarbon, ethylene as a carburizing gas. However, Faure introduces hydrogen in a vacuum carburizing process. After preparing the work for carburizing, Faure backfills the furnace chamber with $H_2$ to a pressure of about ½ atmosphere. Ethylene is then metered into the furnace while the chamber is pumped down to normal vacuum levels in the range of 7.5 to 75 torr. As the ethylene is pumped in, the $H_2$ is pumped out. At the same time, cracking of ethylene produces $H_2$, so some $H_2$ is made up. However the 112 is being reduced during the process from a "high" of up to 60% at the beginning of the cycle to a "low" as little as 2% at cycle end. For reasons discussed below, while 2% is beneficial to the process, Faure is opposite to what is desired.

The literature has also recognized the trend to unsaturated higher order aliphatics. See, for example, the article "New Vacuum Carburizing Technology", published in the February/March 2001 issue of *Heat Treating Progress*, at pages 57–60, which discusses ethylene and controlling tar deposits by introduction of hydrogen (and nitrogen) at high percentages. The article states that if hydrogen was maintained at greater than 60% of the gas composition in the furnace chamber, soot could be eliminated. For reasons discussed below, it is possible that repeatedly issues concerning the carburized case are present at the high percentages cited. The article "New Wrinkles in Low-Pressure Carburizing", also published in the same issue of *Heat Treating Progress*, at pages 47–51, discusses acetylene in a plasma discharge application.

As is well known, the aliphatic hydrocarbons are divided into two groups, namely, the saturated aliphatics or alkanes or paraffins, and unsaturated aliphatics, which include both alkenes and alkynes. Alkenes are also referred to as olefins and alkynes are referred to as acetylenes. The alkenes or olefins have a carbon—carbon double bond and include compounds such as ethylene (or also called ethene) and is denoted chemically by the formula $C_2H_4$. Alkynes with the triple bond include gases or compounds like acetylene (also called ethyne) and is denoted by $C_2H_2$ or HC~CH with triple bonds between the HC and OH molecules or carbon pairs. Alkanes include methane, ethane, propane, butane, pentane, hexane, heptane, octane, and nonane. All of the alkanes can be expressed as the formula of CH (fl*2+2). In regard to the alkenes and alkynes, a different but repeating process occurs for the hydrogen to carbon relationship. The family of alkenes is expressed by the relationship of $C{\sim}H_{2-}$. Thus, in the case of ethylene $C_2$1-L, the number of H" is strictly double that of the "C". Also in the alkene family is propylene $C_3H_6$. The family of alkynes is expressed by the formula $C_nH_{2n-2}$. An example of this compound is acetylene $C_2H_2$.

In addition to the relationship between the hydrogen to carbon count, there is a special relationship regarding the number of bonds between the carbons. Alkanes have one bond between each C and as previously indicated, alkenes have two bonds and alkynes have three. In regard to the arrangement of the carbon hydrogens to each other, the aliphatics are characterized as "string" compounds that can be straight or branched chain. The strings are represented as HC~CH for acetylene instead of simply $C_2H_2$. The carburizing gases thus used in vacuum furnaces prior to this invention had hydrocarbon in which the carbons were bound together in a string or chain.

The vacuum processes in the prior art discussed above have been confronted with at least two problems. The first problem is that they have only been able to supply a level of carbon at saturation or above. The high carbon potential is often rejected by many because carbide networks are typically formed which is undesirable. To combat the carbide network previous methods have removed the carbon bearing gas by evacuation or the turning off of the plasma to allow the carbide networks to diffuse away or homogenize into the steel. This approach does work, but it is not truly desirable since the carbide networks are considered bad in most cases.

As noted, when unsaturated aliphatic hydrocarbons break down during carburizing, they produce a by-product known as soot which includes tar as well as solid carbon particles. The soot collects in the furnace after the process and must be removed. This requires extra maintenance and expense to keep the operation clean and reduces productivity. The higher order hydrocarbons especially have a tendency to deposit soot. In the one article cited, high quantities of hydrogen are introduced into the furnace, which could, in theory, raise repeatability issues. In the '540 acetylene patent, high vacuum levels are required to prevent soot formations, according to the theory of that patent.

In all the vacuum technology prior art, the carburizing gas is introduced at levels sufficiently high to saturate the workpiece surface and the gas metering is stopped to allow diffusion. This results because there is no way to control the carbon potential in the vacuum environment. For gas atmosphere carburizing a $CO/CO_2$ ratio can be maintained. However, oxygen does not exist in a vacuum carburizing process and the vacuum drawn is constantly drawing out the carburizing gas.

Insofar as vacuum carburizing apparatus is concerned, all conventional apparatus meters the carburizing medium into the furnace chamber as a gas. In fact, all industrial furnace heat treat processes (other than the salt bath class) use gas, although there are one or two known instances where kerosene was dripped into a positive pressure furnace chamber (gas carburizing) or where one of the pretreatment gas pressures was inadvertently controlled so that liquid nitrogen was inadvertently injected into the furnace. Carburizing occurs immediately upon introduction of the carburizing medium into the furnace chamber and the vacuum reduces the moles of carburizing gas present in the furnace chamber. The controllability of the process is therefore a function of the sensitivity of the mass flow controller and the ability of the gas flow metering valves to meter the gas. In vacuum carburizing (and until this invention), no in-situ measurements of the gas in the furnace chamber were taken. Only one gas was used and the gas flow was set at a carbon potential t produce a saturated iron carbide surface that was subsequently diffused into the case. Where an additional gas was used (hydrogen or nitrogen for carbonitriding), that was also set at a fixed quantity. In summary, for a number of reasons, there is not believed to be any in-situ gas control of the vacuum carburizing process until this invention.

For the higher order unsaturated aliphatic hydrocarbons which are highly reactive the system that is used to pressurize and deliver the gas to the furnace can affect the composition of the gas metered into the furnace. Depending on the purity of the feedstock and the gas delivery system, variations in the hydrocarbon make-up can occur. While the fact that there may be some cracking of the hydrocarbons in the delivery system will not materially alter the carburizing process (since the 110 must be cracked anyway to produce the carbon) in theory variations are possible in the gas delivered to the furnace and this relates to precise control and repeatability of the process.

For acetylene, the complications may be more severe. Acetylene in the pressurized cylinder form is supplied with acetone as one of the components. The weight of acetone settles that component to the bottom of the cylinder. As the contents of the cylinder are consumed to provide acetylene gas, the gas layer at the top of the cylinder can, in theory, carry some acetone with it. Acetone produces oxygen on decomposition which is to be avoided in-vacuum carburizing. Thus, the possibility of acetone in the acetylene gas increases as the bottled acetylene tank is used up.

SUMMARY OF THE INVENTION

Accordingly, it is one of the major undertakings of the present invention to provide a system (method and apparatus) which is an improvement in the art of vacuum carburizing ferrous workpieces.

This object along with other features of the invention is achieved in a method or process for vacuum carburizing which is conventional in the sense that ferrous workpieces are heated to a carburizing temperature in a cleansed furnace pressure chamber that is maintained at a vacuum while a carburizing gas within the furnace chamber disassociates to produce carbon absorbed into the surface of the workpiece to produce carbon in solution and iron carbide, $Fe_3C$. The improvement includes the step of metering a cyclic hydrocarbon, and more preferably, a naphthene cyclic hydrocarbon, and still more preferably, a naphthene having a 5 or 6 sided carbon ring into the furnace chamber whereat the hydrocarbon is a carburizing gas. Preferably, the naphthene hydrocarbon is selected from the group consisting of cyclohexane, including variations thereof such as methylcyclohexane, ethyl cyclohexane, dimethyl cyclohexane, trimethyl cyclohexane, etc., and cyclopentane, including variations thereof such as methylcyclopentane, ethyl cyclopentane, etc. It is believed that the stable carbon ring of naphthene in the vacuum environment of the furnace chamber minimizes carbon soot forming deposits while the ferrous surface of the workpiece functions as a known catalyst to speed the cracking of the ring hydrocarbon so that the carbon in the naphthene molecules can be absorbed onto the surface of the workpiece in a manner not entirely dissimilar to the glow discharge of the ion process described above.

In accordance with another aspect of the invention, the only carburizing gas in the furnace chamber is the naphthene hydrocarbon which is metered at a quantity sufficient to establish a carbon potential that produces saturated carbon in solution and iron carbide over the surface of the workpiece. The process continues conventionally by maintaining a vacuum after the naphthene has stopped flowing into the furnace chamber for a set time period sufficient to allow diffusion, of the carbon saturated at the surface of the workpiece into the case. In Accordance with this aspect of the invention, the vacuum carburizing process is entirely conventional but for the utilization of only the naphthene hydrocarbon as the carburizing medium.

In accordance with another aspect of the invention, hydrogen is metered into the furnace chamber with the naphthene hydrocarbon at a rate which is insufficient to allow the carbon potential in the furnace chamber to drop below the carbon saturation limit of the workpiece. Preferably, the hydrogen flow is metered at a molar flow rate which does not exceed about twice the molar flow rate of the hydrocarbon, and still more preferably, the flow rate is about in the range of 0.5 to 1.5 times the flow rate of the naphthene hydrocarbon, and most preferably, is flowed into the furnace chamber at a rate of approximately one mole of hydrogen to one mole of hydrocarbon gas. Preferably, the carburizing hydrocarbon flow is set at a value sufficient to produce upon cracking of the cyclic hydrocarbon ring a quantity of carbon which is more than sufficient to produce on the surface of the workpiece a saturated carbon in solution and an iron carbide network precipitating therefrom to assure thorough carburizing and the additional quantity of hydrogen forms methane with the excess carbon thereby tending to avoid the formation of intermediate hydrocarbons such as ethylene, acetylene as well as the higher order alkanes such as propane. In summary, the hydrogen functions as a "getter" to form methane (the simplest form of hydrocarbon) and is metered at a rate which does not interfere with the saturation of the workpiece surface. At the same time, the rate is sufficient to provide a sufficient amount of hydrogen to readily form methane thereby tending to avoid the formation of higher order hydrocarbons which, in turn, could contribute to furnace sooting. Once saturation is achieved, the process continues with a conventional diffusion step.

In accordance with another separate but important aspect of the invention, the rate at which hydrogen and naphthene are admitted to the furnace chamber are variably controlled during the carburizing process so that an excess amount of hydrogen is present in the furnace chamber to prevent the carbon from the cracked naphthene ring to achieve saturation levels of carbon in the workpiece surface. In accordance with this aspect of the invention, the metering of the hydrocarbon and hydrogen gas ratio is controlled throughout the carburizing process at set but variable carbon potentials up to saturation (i.e., about 1.3 to 1.4 percent carbon). Accordingly, a diffusion step is not required and carburizing process times should therefore reduce. In summary, this feature of the invention provides, for the first time, variable carburizing in a vacuum furnace.

In accordance with yet another aspect of the invention, a methane analyzer is utilized to determine the in-situ status of the carburizing process. This feature of the invention is based on one of the invention's underpinnings, which is the recognition that methane is substantially inert or transparent to the carburizing process at the low pressures at which this invention operates. (This invention operates at conventional high vacuum levels in that carburizing occurs at pressures of 100 torr or less, more preferably, at about 20 torr or less and still more preferably, at about 10 torr. There is no lower limit, but the preferred embodiment for process time consideration is set at about 10 torr.) The recognition of the transparency of the methane is then coupled with the observation that as the surface of the available iron on the workpiece becomes saturated with carbon, the methane concentration rises. Accordingly, any instrument that can measure the concentration of methane in the vacuum chamber on a real time basis (an in-situ instrument) can be utilized to determine the status of (and the control of) the carburizing process. Preferably, a non-dispersive, infrared analyzer is used to detect the presence and concentration of methane in the furnace chamber and to control the metering of the carburizing gas. The NDIR sensor can be used to simply indicate that saturation is achieved or monitor the process or the NDIR sensor can be used to control the metering either to achieve saturation or to establish variable carburizing.

In accordance with one of the principal objects of the invention, it is believed that metering of hydrogen (and not any inert gas) contributes to stabilizing the integrity of the naphthene ring which is inherently stable so that the naphthene is cracked at the workpiece with any free or activated carbon that is not absorbed by the workpiece surface reacting with excess hydrogen to readily produce the lowest order hydrocarbon, methane. While the ring integrity is particularly advantageous for naphthenes because of the precise correlation between the presence of methane and presence of carbon potential control, the use of excess hydrogen in combination with any carburizing gas and the in-situ sensing of the presence of methane in the vacuum carburizing chamber is believed applicable to any hydrocarbon carburizing gas (other than methane). This aspect of the invention is not necessarily limited to a naphthene hydrocarbon as the carburizing medium but is applicable to any vacuum carburizing gases, especially the higher order alkenes.

In accordance with another important aspect of the invention, the naphthene hydrocarbon is provided in liquid form and metered in liquid form into the furnace chamber whereupon the naphthene hydrocarbon is vaporized into gas from the heat and pressure of the furnace chamber. The naphthene liquid feedstock is commercially available with purity levels in excess of 99%, preferably in excess of 99.9% pure, with the balance comprising various hydrocarbons so that variations in the carburizing gas do not occur resulting in precise control of the carburizing process to produce uniform carbon disbursed case with excellent repeatability.

In accordance with yet another important aspect of the invention, a conventional, automotive type fuel injector is utilized as the mechanism to meter the liquid naphthene hydrocarbon into the furnace chamber whereby the pulsing of the injector inherently produces an intermittent gas flow which is conducive to dispersing itself about the workpiece. The liquid fuel injector arrangement thus produces, by pulsing, a uniform distribution of carbon about the surface of the work, which is difficult to achieve when the carburizing gas is conventionally metered in gas form into the furnace chamber. Preferably, the pulse width of the injector and the timing between pulses is varied during the time the carburizing gas is admitted into the furnace chamber such that the gas can be more readily disbursed about convoluted surfaces of the workpiece and in the space between the workpieces when placed into the conventional work basket tray. Still more preferably, a plurality of injectors are circumferentially spaced about the furnace chamber and not only is the pulse width and frequency varied during the time the gas is admitted into the furnace chamber, but the firing order or sequence may be varied to positively produce a desired dispersion of gas flow among and between the workpieces. While injection pulsing of a liquid carburizing medium has specific benefits with respect to its application for a naphthene hydrocarbon because of the chemistry involved, the dispersion characteristics of carburizing gas achievable with pulse injection of a liquid hydrocarbon does not limit this aspect of the invention to a naphthene hydrocarbon carburizing medium. Specifically, conventional and other hydrocarbons may be supplied in liquid form with pulsed injection to achieve better dispersion of the carburizing gas throughout the work and also to supply hydrocarbon in liquid feedstock form which may have higher purity than that which might otherwise occur with a conventional gas supply stream.

In accordance with a more specific feature of the invention, the injector is provided with an expansion chamber downstream of its outlet and upstream of the furnace chamber whereby vacuum from the furnace chamber can be utilized to cause vaporization of the liquid hydrocarbon without adversely causing fluctuating vacuum levels within the furnace chamber proper. While the furnace chamber is under a high vacuum (low pressure) it has been surprisingly discovered that the large volume of the furnace chamber serves to function as a reservoir and dampens the pulsation so that the vacuum functioning of the furnace is not adversely affected. Preferably, when the hydrogen alternative embodiment is utilized, hydrogen is supplied to the furnace through the expansion chamber fitted to the fuel injector further minimizing fluctuations attributed to the HO pulse. In accordance with another specific but important aspect of the invention, the naphthene hydrocarbon gas is directed against deflection shields, which, in turn, direct the carburizing gas against the surfaces of the work. Importantly, the deflecting shields are transparent to the naphthene gas in that the deflecting shields do not contain iron which can function as a catalyst to assist in the cracking of the naphthene ring. Preferably, the deflection shields (which may take the form of radiation shields conventionally used in vacuum carburizing furnaces) have a surface or coating which can comprise a molybdenum or nickel molybdenum alloy having iron content less than about 5%, a graphite or a silica insulation or a ceramic insulation which has developed a graphite like surface.

In accordance with another aspect of the invention, a vacuum furnace for carburizing ferrous workpieces is provided. The vacuum furnace includes a furnace casing defining a furnace chamber therein, closed at one end by a vacuum sealable door. A heater is provided within the furnace chamber and a vacuum pump is in fluid communication with the furnace chamber. A fuel injection of the pulse operating type is vacuum sealed to an opening in the casing and the fuel injector has an inlet in fluid communication with the source of liquid hydrocarbon under pressure and an outlet in fluid communication with a furnace chamber. A microprocessor controller is provided for controlling i.) the heater for regulating the temperature of the workpiece in the furnace chamber, ii.) the vacuum pump for regulating the pressure of the furnace chamber, and iii) the injector for regulating the pulsing of the fuel injector whereby the carburizing gas uniformly flows about the work surfaces of each workpiece and between the spaces of the workpiece. Preferably the liquid hydrocarbon is a naphthene.

In accordance with this aspect of the invention, the furnace casing is provided with a plurality of hydrogen gas inlets in fluid communication with the furnace chamber and a source of hydrogen gas with the controller regulating the metering of hydrogen through the inlets while the injectors are pulsing the liquid hydrocarbon into the furnace.

In accordance with yet another specific aspect of the invention, the furnace is provided with a sight glass outside the furnace chamber proper and a methane analyzer in the form of an NDIR sensor is adjacent the sight glass. The controller regulates the hydrocarbon gas flow in accordance with the readings from the NDIR sensor, and the controller can optionally or additionally regulate the hydrogen flow either from the hydrocarbon readings or by separate instrument.

In general summary of some of the features of the present invention, an improved gas carburizing system (method and apparatus) results from the use of a naphthene as the carburizing medium. The naphthene has one or more of the following characteristics:

a) better carburizing case for workpieces having convoluted surfaces and/or tightly packed into work trays (attributed to thermal cracking of a stable HC (hydrocarbon) ring over the catalyst (iron workpiece);

b) minimum soot with bright carburized work (attributed to the stability of the HC ring);

c) minimum sooting with especially bright carburized work and an almost pristine furnace chamber (attributed to external hydrogen and generated hydrogen by-product in combination with the naphthene hydrocarbon);

d) variable carburizing is possible (attributed to ability on cracking of ring to directly form methane with the carbon atoms not absorbed into work);

e) repeatability and consistency of carburizing that can be tightly controlled (attributed to purity of the HG in liquid form);

f) cleanliness of naphthene (which is a solvent and does not necessarily have the environmental handling concerns present with other reactive carburizing mediums);

g) inexpensive processing (cost analysis indicates the high concentration of carbons in naphthene result in less naphthene required which is inexpensive):

h) potentially higher throughput (attributed to "localized" reaction of naphthene at the workpiece to flood the surface with carbon atoms and allow, for variable carburizing that eliminates diffusion cycle); and/or, i) easy controllability (attributed to ring allowing for conventional carburizing by a calculated fixed quantity of naphthene to be pumped whereat carburizing stops followed by diffusion or for variable control by methane).

In accordance with other aspects of the invention, features or objects disclosed include, in a broad sense, carburizing control achieved by methane control with externally supplied hydrogen and liquid pulse injecting of the carburizing medium (any hydrocarbon).

These and other objects, features and advantages of the invention will become apparent to those skilled in the art from a reading of the Detailed Description set forth below together with the drawings as described below.

BRIEF DESCRIPTION OF THE DRAWINGS

The invention may take physical form in certain parts and in an arrangement of parts, a preferred embodiment of which will be described in detail and illustrated in the accompanying drawings which form a part hereof and wherein.

DETAILED DESCRIPTION OF THE INVENTION

Figure 1:
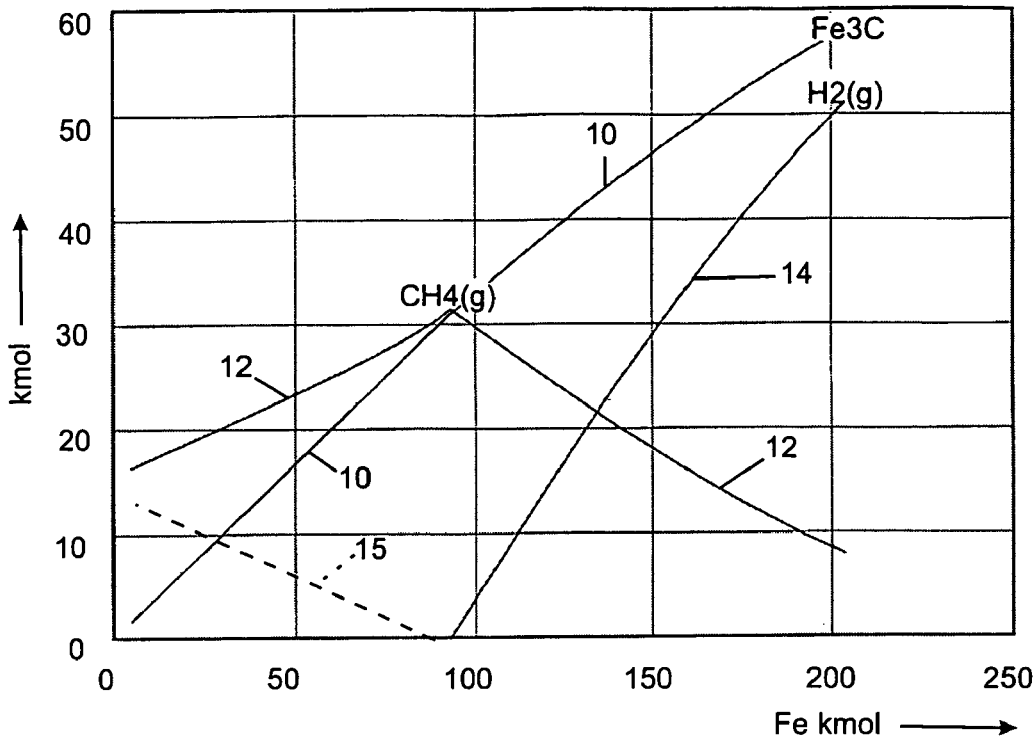
FIG. 1 is a computer generated graph showing the use of cyclohexane to carburize steel.

The Detailed Description of the Invention set forth below is for the purpose of illustrating preferred and alternative embodiments of the invention and is not necessarily for the purpose of limiting the invention.

A. The Carburizing Medium

As discussed in the Background, the carburizing gases heretofore used in vacuum carburizing processes are aliphatics, either saturated or unsaturated. As is well known, the carbons in the aliphatic families can be characterized as string compounds with a backbone classified as either a straight chain or a branch chain. This invention, in its broad sense, selects as the carburizing medium hydrocarbons having a molecular structure in which the carbon atoms are arranged in rings in marked contrast to the string or chain carbon structure which characterizes the aliphatics. As used herein, and as a matter of definition, the term "cyclic hydrocarbon" means those hydrocarbons having a carbon ring alignment connected by any number of bonds. In a preferred embodiment and in a more specific inventive sense, the invention selects from the cyclic hydrocarbons those cyclic hydrocarbons which have a saturated ring and which are commonly referred to in the petrochemical industry as naphthenes. Naphthenes are conventionally referred to as an anti-aromatic, although it may be possible to identify certain naphthenes as saturated aromatics. Naphthene, as used herein, includes those hydrocarbons (cycloalkanes) with the general formula $C_nH_{2n}$ in which the carbon atoms are arranged to form a ring. In any instance, this invention specifically determines that among the cyclic hydrocarbons (hydrocarbons with carbon rings connected by single or double bonds), the naphthenes are specifically designated as the hydrocarbons of choice. Among naphthene hydrocarbons, it is believed that the six-sided ring has the greatest stability and is more stable than seven-sided rings and five is more stable than eight and nine is more stable than four and four has a greater stability than three. For this reason among others it is preferred that among the naphthenes, the specific naphthenes selected in the most preferred embodiment of the invention, include the 5 and 6 sided carbon rings. Not only are the 5 and 6 sided rings most stable, but it is believed that when sufficient energy is inputted to the ring, cracking of the carbon ring tends to proceed to produce activated carbon and hydrogen molecules. The reaction is not believed to tend to produce carbon sided rings of a lower order (assuming the reaction is not hydrogen starved) and the reaction is endothermic. Included in this specific group of naphthenes are cyclohexane, including variations thereof such as methylcyclohexane, ethyl cyclohexane, dimethyl cyclohexane, trimethyl cyclohexane, and cyclopentane including variations thereof such as methylcyclopentane, ethyl cyclopentane, and the like.

As of the date of this application the invention has been demonstrated to work for the 5 and 6 sided carbon ring naphthenes. It is concluded from the data obtained and the literature that carburizing is possible for the entire naphthene family and that any cyclic hydrocarbon can function as a carburizing medium and the invention is not believed limited to the hydrocarbons actually tested. However, the 5 and 6 sided carbon ring naphthenes are especially preferred.

B. Reaction Discussion

1) The Activity of the Carburizing Medium.

Without wishing to be bound by any specific theory, and more particularly, without limiting the invention to any specific chemical theory, it is well known that cyclic hydrocarbons, and in particular, 5 and 6 sided naphthenes such as cyclohexane or cyclopentane, are believed more stable than other hydrocarbons and particularly more stable than the aliphatic hydrocarbon family. In particular, the naphthenes cyclohexane and cyclopentane are more resistant to thermal cracking than the unsaturated aliphatics such as propane, ethylene and acetylene. As used herein, "cracking" means the breaking or rupture of the carbon ring for naphthenes. Cracking for unsaturated aliphatics means the splitting or disassociation of the hydrocarbon molecule into simpler hydrocarbon forms. As is believed well known, aliphatic hydrocarbons crack according to the radical chain theory proceeding from complex hydrocarbons to intermediates and then to simpler forms with the progress of the reaction depending on the cracking condition.

Because the purpose of carburizing is to infuse carbon into the case of the workpiece, intuitively, it is believed that one skilled in the art would not select a hydrocarbon that was resistant to thermal cracking. Accordingly, the recent activity in the carburizing field has for the most part been directed. to selecting as the carburizing gas the higher forms of unsaturated aliphatics, particularly acetylene, with provisions taken to control the carbon sooting that inevitably results from this choice.

However, it is known that the cracking of naphthenes can be quickened in the presence of the catalyst, and catalysts suitable for cracking of naphthenes include not only the noble metal elements but also iron.

The working of the invention can conceptually be theorized to occur as follows:

a) The vacuum furnace which is under a high vacuum (low pressure) during carburizing, draws the carburizing gas out of the furnace so that the residence time of the gas in the furnace chamber is not long in contrast to, for example, gas atmosphere carburizing. The naphthene ring will crack if left at the carburizing temperature over some period of time but the carburizing process tends to negate the cracking by the gas withdrawal at high vacuum. b) However, the workpiece is iron based and when the gas flows against the workpiece, the residence time is decreased and the ring with its abundance of carbon does crack. c) By taking steps to assure that the furnace chamber is somewhat transparent in the sense that it does not promote or serves as a catalyst to speed the cracking of the naphthene, the naphthene gas will then have a tendency to only crack against the workpiece. Activated carbon is thus present in the vicinity of the workpiece where it can be absorbed into the workpiece surface thus minimizing soot. d) In addition, steps are taken by an injection arrangement to assure that the naphthene is circulated about the work before being withdrawn from the furnace and is not "dead ended" into the vacuum exhaust port. At the same time, since the naphthene rings possess an abundance of carbon, the process can proceed quickly to saturation. In summary, a hydrocarbon normally resistant to breaking down but possessing an abundance of carbon is utilized as the carburizing medium because iron can function as a catalyst readily breaking down the stable hydrocarbon at the carburizing temperatures. Then, steps are taken to minimize catalytic reactions with the stable ring hydrocarbons in the furnace chamber except for where the workpieces are so that the carbon produced can be readily absorbed in the workpiece case. Additional steps are taken to insure circulation of the hydrocarbon about the work. Finally, hydrogen is optionally added to insure minimization of carbon soot, for control of the process and finally to achieve equilibrium or variable carburizing.

The above paragraph is a conclusionary summary of the "workings" of the invention based upon observations, tests, measurements, experiments, etc. and clarifications through technical analysis. The above paragraph is also consistent with what is expected or taught in the gasoline reforming art. In that art it is known that iron is a naphthene catalyst and that cracking of the naphthene ring will result in carbonaceous compounds that will be absorbed into and foul the catalysts. One reforming technique teaches isomerization of the feedstock by special catalysts under controlled conditions with ratios of hydrogen to hydrocarbon fed in excess of stoichiometric requirements so that the naphthene ring is opened (not "cracked") and the ring hydrocarbon can be isomerized to the desired branch chain hydrocarbon. (See U.S. Pat. No. 2,348,557 to Mattox, entitled "Treatment of Hydrocarbon Distillates", issued May 9, 1944; U.S. Pat. No. 2,915,571 to Haensel, entitled "Isomerization of Saturated Hydrocarbons", issued Dec. 1, 1959; and, U.S. Pat. No. 4,783,575 to Schmidt et al., entitled "Isomerization with Cyclic Hydrocarbon Conversion", issued Nov. 8, 1988.)

One technical analysis conducted is to determine the ability of the carburizing reaction to occur. For example, methane as a carburizing gas produces carbon in solution and precipitates iron carbide according to the well known equation:

$$CH_4+3Fe \longleftrightarrow 2H_2+Fe_3C$$

As is well known, the carbon will be absorbed into the iron as a solution (i.e., the iron carbon solution Fe(C)) and will also cause iron carbide $Fe_3C$ to form as a precipitate. The carbon is absorbed onto the surface of the workpiece and diffuses into the workpiece case establishing a carbon gradient. As surface carbon concentration increases, the driving force for diffusion increases.

One program which determines the ability of the reaction to occur is available from Outokumpu Research of Finland under the brand name of HSC Chemistry for Windows"™ This program predicts the Gibbs free energy and whether the reaction is likely to occur or not to occur. Specifically, the program lists a "K" value with the higher the "K" value, the more likely the reaction will occur and proceed to completion. The program does not determine the speed of the reaction but it is an indication of the magnitude of the reaction which, in turn, is an indication of the probability of the reaction occurring. However, the program is based on atmospheric pressure and because the application calls for a reaction in a vacuum, higher "K" values are needed to compensate for the reaction slowing up simply because pressure is not present to drive the reaction. This program was run for a number of gases and Table I lists the Gibbs energy as well as the "K" factor produced by the program.

TABLE 1

Gibbs Free Energy Table

| Attach compound | Formula | K Factor | Gibbs Energy kcal |
|---|---|---|---|
| 1. Methane | $CH_4$ | $5.79 \times 10^1$ | −9.463 |
| 2. n-Butane | $C_4H_{10}$ | $3.52 \times 10^{15}$ | −83.449 |
| 3. i-Butane | $C_4H_{10}$ | $1.23 \times 10^{16}$ | −80.420 |
| 4. Propane- | $C_3H_6$ | $1.5 \times 10^{11}$ | −60.11 |
| 5. Acetylene | $C_2H_2$ | $1.84 \times 10^7$ | −38.99 |
| 6. Ethylene | $C_2H_4$ | $1.123 \times 10^6$ | −32.476 |
| 7. Cyclohexane | $C_6H_{12}$ | $2.46 \times 10^{24}$ | −130.92 |
| 8. Methylcyclohexane | $C_7H_{14}$ | $9.249 \times 10^{27}$ | −150.106 |
| 9. Cyclopentane | $C_5H_{10}$ | $2.78 \times 10^{19}$ | −104.372 |
| 10. Methylcyclopentane | $C_6H_{10}$ | $1.36 \times 10^{21}$ | −113.434 |
| 11. Toluene | $C_7H_8$ | $7.38 \times 10^{16}$ | −90.539 |
| 12. m-Xylene | $C_8H_{10}$ | $2.00 \times 10^{21}$ | −114.341 |
| 13. o-Xylene | $C_6H_{10}$ | $2.08 \times 10^{21}$ | −114.427 |
| 14. p-Xylene | $C_8H_{10}$ | $2.16 \times 10^{21}$ | −114.511 |
| 15. Ethylbenzene | $C_8H_{10}$ | $2.15 \times 10^{21}$ | −114.509 |
| 16. Styrene | $C_8H_8$ | $1.31 \times 10^{20}$ | −107.98 |
| 17. Cumene | $C_9H_{12}$ | $7.81 \times 10^{25}$ | −138.99 |

Table Conditions: Atmospheric pressure, Temperature at 900° C. (1650° F.)

Some observations are appropriate. Generally, the assignee has concluded that a Gibbs number in the order of −9 or more negative will produce a good carburizing reaction and explains why methane is the gas of choice for gas atmosphere carburizing. When a vacuum is drawn and the vacuum is high (low pressure—e.g. at 10 torr there is only 10/760 absolute pressure available) the driving force for the reaction will drop significantly. The driving force is maybe 1/10th the power at the low pressure as compared to atmospheric and therefore completely or near completely negates the driving force at low pressure. in the case of methane, the assignee has determined that methane, for vacuum carburizing, has not produced especially good carburizing results until the furnace pressure is increased into the neighborhood of 350 to 400 torr. At the high vacuum (low pressures) levels at which the vacuum carburizing process of the invention operates, methane is believed to make little, if any, contribution for carburizing the workpiece and the table above provides a logical explanation for the reason why methane is not an effective carburizing medium at high vacuums. In fact, at the low carburizing pressures of the invention (100 torr or less, preferably 20 torr or less and most preferably, about 10 or 9.5 torr), methane can be viewed as transparent or inert for carburizing purposes.

Accordingly, the second conclusion that can be drawn from the above table is that the more negative the Gibbs number, the more likely the reaction will proceed. It is noted that acetylene and ethylene have been recently commercially used as a carburizing gas and their more negative Gibbs number indicate that the gas will be more likely to sustain the reaction at the higher vacuum levels. Not shown in the table above is the endothermic versus exothermic reaction of the gases at the temperatures indicated. In this regard acetylene and ethylene are exothermic and the remaining gases in the table at vacuum carburizing temperatures are endothermic. Because the carburizing furnace supplies heat, whether the reaction is exothermic or endothermic is not considered material to the process (except to control the carburizing temperatures). An exothermic reaction may, however, indicate a more reactive reaction and may be an additional factor contributing to the commercial utilization of these gases. It is also noted that the conventional carburizing gas, propane, has a relatively high Gibbs energy number. It is also noted that the more negative the Gibbs energy number, the more likely that activated carbon can be deposited into the furnace to form carbon soot. In this regard, a good deal of the prior art operating with carburizing gases at the high negative Gibbs numbers is concerned about carbon soot formation and adjusts the process cycle to account or diminish the effects of the excess carbon. In addition to the carburizing prior art discussed in the Background, a number of carburizing processes will inject the gas for timed periods followed by diffusion to minimize carbon deposition in the furnace.

With respect to the carburizing medium of the invention, compounds listed as items 7–17 represent the cyclic hydrocarbons which the invention is broadly directed to and compounds 7–9 are samples of the preferred 5 and 6 sided carbon ring hydrocarbons. The Gibbs numbers are much more negative than those listed for the conventional gases. This indicates that the carburizing reaction will occur over a relatively high vacuum range. This conclusion has been borne out by a number of tests which show that carburizing can proceed over a wide vacuum range with gases of the preferred embodiments.

The high negative numbers also indicate that carbon sooting should present a major problem in the carburizing process. Surprisingly, the parts carburized with the carburizing medium of the invention turn out bright (with excess hydrogen the parts are especially bright) and there is little if any carbon soot buildup in the furnace chamber. The conclusion is therefore drawn that the normal high vacuum levels of the vacuum carburizing furnace (10 torr or less) coupled with the stability of the hydrocarbon ring, produce the exceptionally good carburizing results discussed below without formation of any considerable carbon soot deposits. One caveat is that the furnace chamber is substantially transparent to catalytically reacting with the carburizing medium. That is, it has occurred to the inventors that given the long time history of carburizing, somebody would have used a cyclic hydrocarbon as the carburizing medium for the carburizing process. If this was attempted and the furnace chamber proper comprised substantial portion of exposed iron or catalytically reactive surfaces, the ring would crack over all those surfaces and substantial amounts of carbon would be deposited. As will be explained below, the vacuum furnace chambers used in the present invention do not have substantial amounts of catalytically reactive material in the furnace chamber.

Before continuing the theoretical discussion of what transpires in the vacuum carburizing chamber during vacuum carburizing, some basic mathematical concepts concerning furnace volume, the relationship of volume to pressure and the number of moles of carburizing medium that are possible at any one point in time in the vessel should be reviewed. Because the pressure is low and the furnace volume is fixed, there can only be "x" number of gas moles in the furnace chamber. Test data referred to later in this Description was accumulated by tests conducted in a 36-48-36 (maximum work tray size of 36" wide by 48" long by 36" high) cold wall vacuum furnace having a furnace volume of approximately 9,800 liters or in a similarly sized hot wall furnace, having a furnace chamber volume of approximately 14,000 liters. (The hot wall furnace has a greater volume because of an external cooling blower and a water cooler.) For the hot wall vacuum furnace having a volume of approximately 14,000 liters, one mole of gas at standard atmosphere pressure yields, as is well known 22.4 liters. Therefore, at standard atmospheric pressure and 0° C. temperature, 625 moles of gas will fill vacuum chamber. Because the tests are run at 10 torr (and not atmospheric pressure of 760 torr) there will be at any given time in the furnace chamber at this pressure 10/760×625 or 8.2 moles of gas. Because carburizing occurs at say 1700° F., there is a gas expansion of 4 times and therefore the mole count is reduced (8.2/4) to about 2 moles. Different pressures and different temperatures produce proportional molar volume gas changes. Based on the surface area of the load, the amount of hydrocarbon gas introduced, the hydrogen and methane gas by-products resulting from the reaction, it is possible to calculate through one of the HSC programs mentioned above, how much surface area of raw steel can be processed. The assumption is that the furnace chamber is at constant temperatures. (In reality, the furnace chamber will have a variation in temperature so that in practice an additional factor is applied to the calculations which does not affect the discussion.) It is also to be noted that there is a large volume in the vessel and it has been observed that this large volume acts as a buffer tank or a reservoir and smoothes out any interruptions in gas flow (discussed below in greater detail for the injector embodiment) that might occur. In this theoretical discussion, the gas flow is constant. What is observed during testing is that the gas make-up in the furnace chamber during carburizing is methane and hydrogen when the preferred six or five carbon ring hydrocarbon gas (cyclohexane or cyclopentane) is used with the flow rates as discussed and the furnace pressures are about 10 to 20 torr. It is possible that if the flow rates materially increase, that intermediate hydrocarbons may form. However, they have not been observed at the flow rates and pressures discussed.

2) The Carburizing Reaction.

With the above as background, reference may now be had to FIG. 1 which is a computer constructed graph using one of the HSC programs. The vertical or "y" axis designates moles of gas and the "X" axis designate "moles" of iron, Fe, available for carburizing. Further, while $Fe_3C$ is a precipitate formed during the carburizing, it does indicate the amount of carbon which has gone into solution with iron. The traces plotted include an $Fe_3C$ "mole" trace designated by reference numeral 10, a methane, $CH_4$, trace designated by reference numeral 12 and a hydrogen, $H_2$, trace designated by reference numeral 14. Moles of iron, Fe, and moles of iron carbide, $Fe_3C$, are solids and do not exist as gases. They are designated as equivalents of gas for purposes of the graph in the sense that they represent a relative quantity of a solid material that can be designated as an equivalent to a mole of gaseous material for purposes of discussing the gas/solid reaction known as carburizing. The discussion of the reaction is started at the far right hand side of the graph where there is a maximum surface area of iron which is available to be carburized and is designated as representing an equivalent of 200 moles of Fe. That is, at the start of the carburizing process, there is a surface area of iron equivalent to 200 moles of Fe available for reaction purpose. This 200 moles of iron can ultimately make about 60+moles of iron carbide, $Fe_3C$, (3 moles of iron plus one mole of carbon yields one mole of $Fe_3C$). This is a theoretical maximum which, for a number of reasons, not relevant to this discussion, cannot be reached. In the FIG. 1 graph, a fixed number of moles of cyclohexane ($C_6H_{12}$) is inputted into the solid iron ("green") workpiece. For example, 10 moles of cyclohexane provide 60 moles of carbons. The computer program takes the 10 moles of cyclohexane through to completion (cracks or disassociates the cyclohexane). Thus, 60 moles of carbon in the cyclohexane produced a maximum amount of $Fe_3C$ and the balance of the carbon produces a minimum number of $CH_4$. Because all the hydrogen from the cyclohexane was not used to make methane, there is a maximum amount of free hydrogen available.

As the carburization process continues, the workpiece surface area becomes saturated with carbon and diffusion must occur to remove the carbon from the work surface area. As the process continues, the lower depths of the workpiece saturate also and the demand for carbon drops. An alternative way of viewing the diffusion is to simply state that the total amount of Fe available to absorb C and form $Fe_3C$ at the surface of the workpiece decreases. This decrease in Fe is shown on the Fe axis. Attention should be directed to the 150 Fe "mole" mark on the "x" axis. At this point in the process some diffusion has taken place and the surface area available for forming $Fe_3C$ is reduced to 150 moles of Fe. In this condition of the workpiece, if 10 moles of cyclohexane are cracked, the amount of $Fe_3C$ that can be produced is reduced. The 10 moles of cyclohexane now produce more free carbon which uses the hydrogen from the cyclohexane molecule to make methane. Thus, the $CH_4$ increases and the free hydrogen reduces. There comes a point which is shown in FIG. 1 at slightly below the 100 Fe point on the" axis where the diffusion has reduced the surface area of the workpiece so that the number of "free" carbons not absorbed into the workpiece surface require more hydrogen than is available from the cracked cyclohexane to form methane. This point starts slightly to the left of the peak on $CH_4$ trace 12. The carburizing continues but because of the limited number of moles of hydrogen, intermediate hydrocarbons are formed. The formation of the intermediate hydrocarbons would include alkenes such as ethylene, acetylene, and alkanes such as butane, propane and possibly benzene rings. The formation of the intermediate hydrocarbon is designated in the graph of FIG. 1 by the dashed line designated by reference numeral 15. At the far left hand side of the graph the condition is represented where the workpiece has its surface almost saturated with $Fe_3C$. At this point, 10 moles of cyclohexane when cracked will produce little $Fe_3C$ and since there is insufficient hydrogen to form methane with all of the cyclohexane carbon atoms, the intermediate hydrocarbons will become a maximum.

FIG. 1 correlates somewhat to what is repeatedly observed in the carburizing test. On introduction of cyclohexane into the furnace chamber on a green piece, there is little methane present and a significant quantity of hydrogen. If the carburizing flow is maintained constant, for example 1.2 liters per minute, the methane concentration increases and the hydrogen concentration decreases. What is important is the observation that the gases resulting during the carburizing process are methane (potentially benzene rings could be formed) and hydrogen and there is a relationship between the quantity of methane produced during the carburizing process and the completion of the carburizing process.

Numerous tests using only cyclohexane as a gaseous medium inside the furnace have repeatedly produced bright workpieces, uniform case depths, and little carbon deposits or soot in the furnace chamber. If there are intermediate hydrocarbons resulting from cracking the carbon ring as indicated by the HSC program, they are not believed significant because of the cleanliness of the furnace. Because the carburizing process works with only the cyclic hydrocarbon medium introduced into the furnace, the invention does not require the introduction of any additional gas in the carburizing cycle for carburizing to occur.

From FIG. 1, it is believed that any tendency of the cyclic carbon ring to form lower intermediate hydrocarbons such as ethylene, acetylene, propylene, etc., when the ring is cracked, can be minimized if excess quantities of hydrogen are present in the furnace chamber. Reference can be had to the computer generated graph illustrated in FIG. 2 which is similar to the graph shown in FIG. 1 but with the exception that in addition to the 10 moles of cyclohexane, 80 moles of hydrogen are also inputted into the furnace chamber. At the right hand portion of the graph of FIG. 2, which indicates that the entire surface area of the workpiece is iron, saturation of $Fe_3C$ indicated by plot 20 will occur. A high quantity of hydrogen indicated by plot 22 is present because of the hydrogen available from the cracked cyclohexane plus the external addition of the 80 moles of hydrogen. Similarly a relatively low quantity of methane indicated by plot 24 is also present because most of the carbon from the cyclohexane has been absorbed into the part surface. When diffusion occurs such that only half the surface area of the iron workpiece is available for iron carbide, which is represented by the middle portion of FIG. 2, the methane plot 24 has increased and the hydrogen plot 22 has decreased. As diffusion continues such that less surface area of the workpiece is available for forming iron carbide, the methane continues to increase and the hydrogen continues to decrease. The excess hydrogen, in effect, is believed to act as a "getter" inducing the formation of methane and minimizing the formation of the hydrocarbon intermediates. In fact, the HSC program indicates that no hydrocarbon intermediates are formed when excess hydrogen is present. Tests conducted with hydrogen and cyclohexane metered into the furnace chamber at approximately equal flow rates verify the discussion above with respect to FIG. 2. The workpiece surface is exceptionally bright and the furnace chamber is actually pristine when hydrogen is admitted with the cyclohexane. Additionally, and as will be discussed below, very close carburizing tolerances have been maintained for workpieces with convoluted or geometrically complicated surfaces.

The-HSC programs predict the final or end reaction and are somewhat consistent with the test observations over many carburizing runs. However, the rupture or breaking of the naphthene ring is a very complicated process and can produce a number of different hydrocarbons (see for example, an article entitled "Thermal and Catalytic Decomposition of Hydrocarbons" by A. J. de Rosset and C. V. Berger appearing at pages 680–683 of the August, 1961 issue of *Industrial and Engineering Chemistry*—Vol. 53, No. 8). Whatever may be formed on breaking or cracking of the naphthene ring is not relevant to the invention so long as the end result of the final process after whatever reactions have occurred or are occurring is the formation of methane (assuming sufficient hydrogen) which has been observed and measured. There are at least two points to consider when comparing the hydrocarbon reactions in the vacuum furnace chamber during the carburizing process with published data in the petroleum refinery field or other analytical studies. In carburizing, some number of activated carbon atoms resulting from rupture or breaking of the ring are absorbed into the workpiece. Formation of other hydrocarbon forms may not readily occur because the number of free carbon atoms otherwise available are simply not present. Second, the path of the vaporized naphthene is to the vacuum pump exhaust. Some molecules get deflected and travel a longer path increasing their residence time. Some naphthene molecules get deflected and contact the workpiece catalyst. Some naphthene molecules (a small percentage) dead end straight to the exhaust path. In all probability, some bell shaped reaction curve exists (and this invention with pulsed injection is believed to narrow the spread of the curve). In practice then, all that can be the is that the naphthene hydrocarbon, with sufficient hydrogen, will produce carbon in the workpiece and, as an end gas reaction or as a by-product of the reaction, a gas composition having methane with balance substantially comprising hydrogen will be produced. The gas by-product will normally comprise a gas having a substantial portion of methane and hydrogen as components, with "substantial" meaning that the methane and hydrogen components together comprise more than 50% of the by-product gas.

3) The Methane Significance and Methane Analyzer.

Because methane has an absorbable wave length, this invention utilizes in the preferred embodiment a non-dispersive infrared detector (NDIR) to determine the concentration of methane present at any times in the vacuum chamber for process control. From the first part of the theoretical discussion in this section, it was determined that methane at the low pressures and the flow rates (determined as a function of the carbons present in the cyclic hydrocarbon rings needed to be absorbed into the workpiece) is non-reactive to the workpiece in a carburizing sense. From the second part of this theoretical discussion, it was determined that methane increases as the carburizing process proceeds so long as there is sufficient hydrogen present to form methane with the free, non-absorbed cyclohexane carbon. Thus, in the third step of this theoretical discussion, methane is being measured in-situ by an infrared sensor (as explained further below) while the carburizing process proceeds for purposes of control. In this regard, it should be noted that the assignee's predecessor, in U.S. Pat. No. 4,191,598 to Conybear et al., developed a process where the drawn gas under vacuum was returned to atmospheric pressure outside the furnace, analyzed and then supplied with an enriching gas which was pumped back into the furnace to allow the carburizing process to proceed with a precise quantity of carburizing gas. As a function of the enriching gas to be supplied, the extent of the carburizing process could be ascertained. However, this required an outside loop with an atmosphere gas analyzer and response time as well as precise control were questionable. The prior art (the '355 patent mentioned in the variable carburizing section below) has disclosed an in-situ laser sensor for measuring the endothermic gas composition in the gas atmosphere carburizing process thus avoid the slip stream of gas necessary to take the $CO/CO_2$ measurements.

Conceptually, this invention uses an in-situ methane analyzer or, for reasons which will be explained shortly, an in-situ methane and hydrogen gas analyzer to control the metering of the carburizing gas or the metering of the carburizing and hydrogen gas or to simply monitor the carburizing process or to control the carburizing process such as signaling an end to the process. Any in-situ gas analyzer measuring the gas under vacuum can be used in accordance with this broad aspect of the control features of the present invention. Conceptually, a gas chromatograph or a residual gas analyzer (RGA), a paramagnetic detector, or a mass flow spectrometer could be used. See for example, U.S. Pat. No. 5,528,032 to Uchiyama, entitled "Thermal Desorbtion Gas Spectrometer", and U.S. Pat. No. 5,093,571 to Inomata et at., entitled "Method and Device for Analyzing Gas in Process Chamber", which are incorporated by reference herein for their disclosure of utilizing mass spectrometers to analyze gas composition of a process under vacuum. A mass spectrometer is not especially preferred because the spectrometer is typically under a higher vacuum (lower pressure) than that at which the vacuum carburizing furnace is typically operated. Also, a mass spectrometer would typically require a trap in the furnace and perhaps an additional pump. Additionally, a mass spectrometer, while conventionally used in the semi-conductor heat processing field, is not really suitable for use in the steel vacuum carburizing field. However, methane is strongly absorbed in the infrared spectrum between 3.1 and 3.6 microns in wavelength. An infrared detector or sensor can be positioned in the furnace chamber, preferably in a dead end duct affixed to the furnace chamber or upstream of the evacuation valve(s), and can measure the concentration of methane gas with spectral filters set at the methane wave length. Because of the absence of oxygen there is no danger of explosion from the infrared source.

Figure 6:
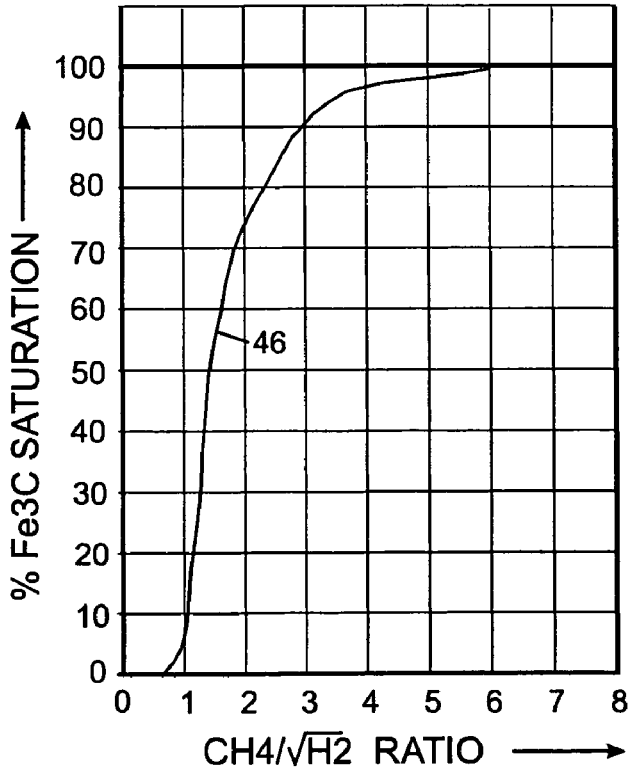
FIG. 6 is a constructed graph depicting the methane-hydrogen relationship necessary to achieve vacuum carbon potentials.
Figure 4:
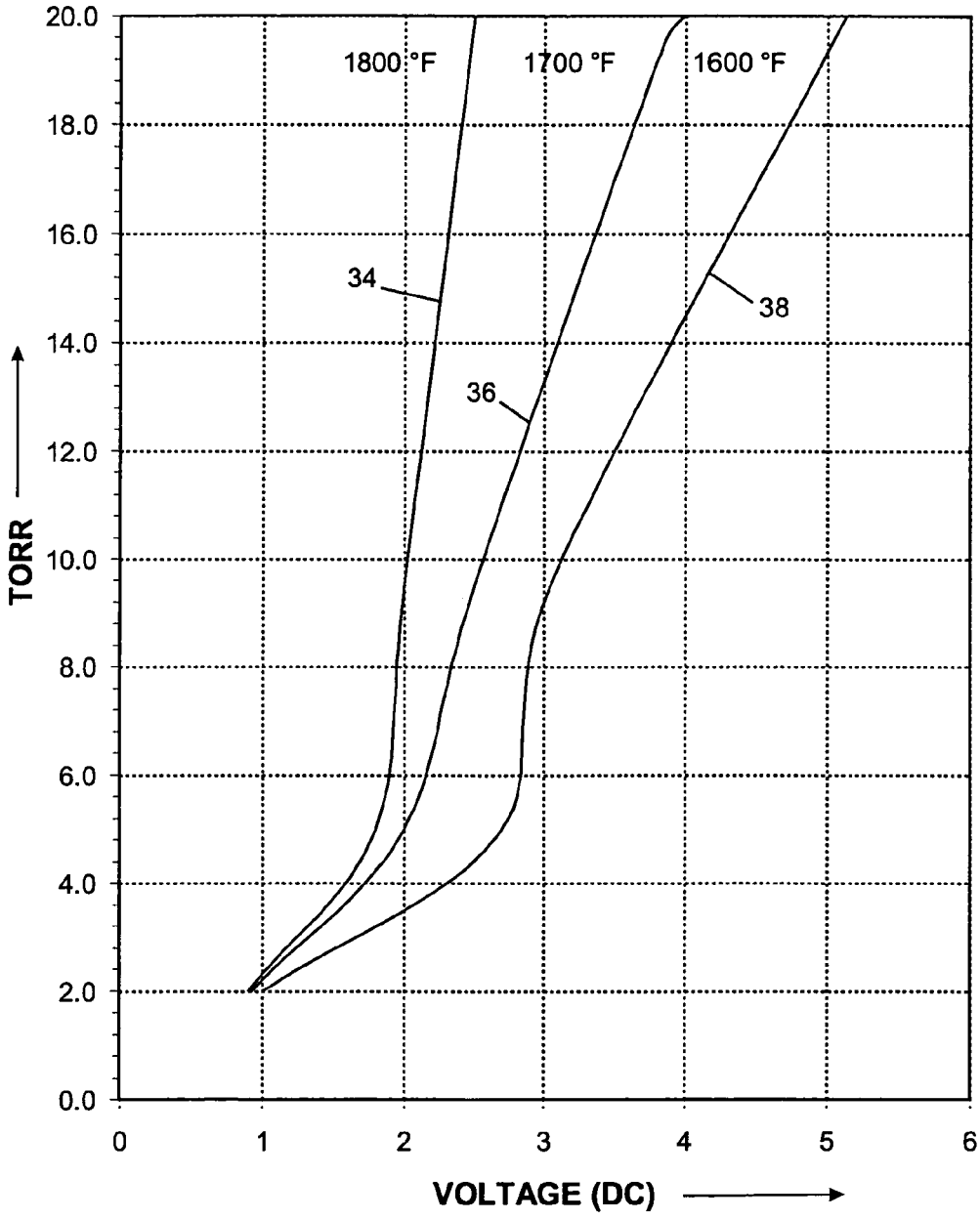
FIG. 4 is a series of 3 graphs showing infrared sensor voltages generated when carburizing work at different temperatures.
Figure 5:
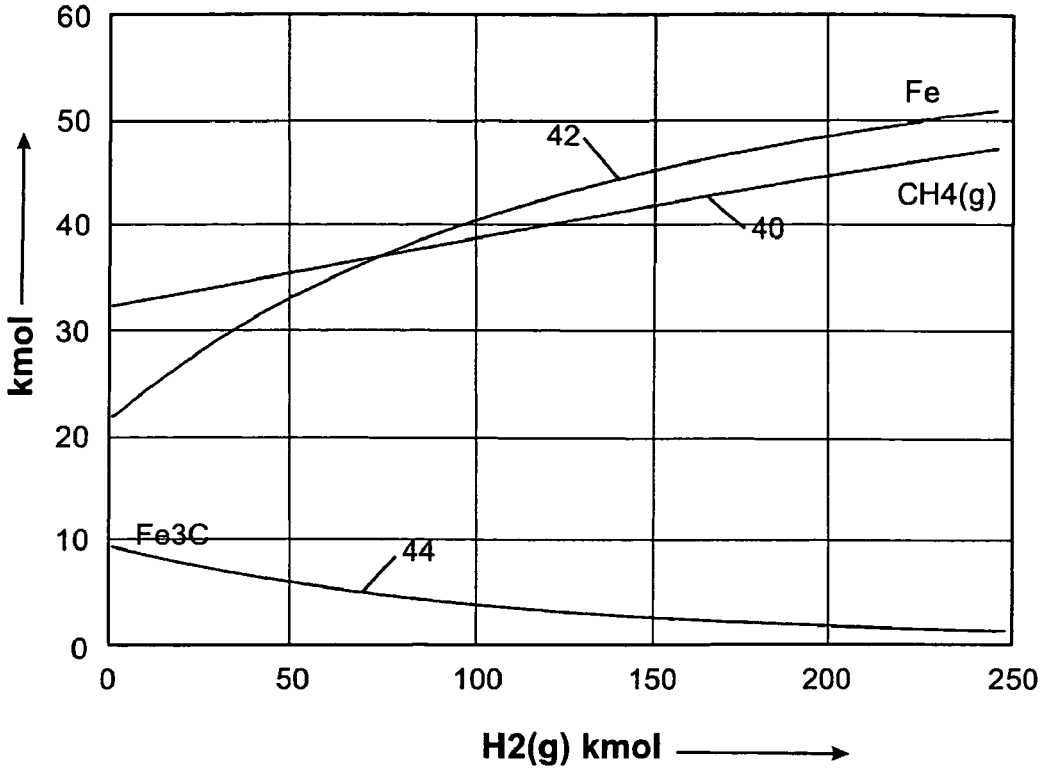
FIG. 5 is a computer generated graph showing the effect of hydrogen on vacuum carburizing with cyclohexane.

Infrared sensors are well known in the art so a detailed description will not be set forth herein. Reference can be had to U.S. Pat. No. 6,237,575 to Lampert et al., entitled "Dynamic Infrared Sensor for Automotive Pre-Vaporized Fueling Control", which is incorporated by reference herein for its description of the electronics illustrated in FIG. 8 of the '575 patent which provide a fast response time without a reference beam, hydrocarbon calibration and its positioning of the infrared source and detectors as shown in FIGS. 4 to 6 of the '575 patent. In the prototype unit, an analog infrared sensor measuring output in DC volts was used. The sensor uses an infrared source with a fan blade and chopper wheel to allow the beam to alternately pass through the vacuum duct or a reference passage open to atmosphere in an especially formed duct flange. Appropriate optical filters between the source and the detector allow absorption of wavelengths characteristic of methane. (Note that the benzene ring hydrocarbon has a somewhat similar wavelength but this is irrelevant to the discussion. Assume benzene and $CH_4$ were present. The sensor still records a repeatable pattern.) Reference can be had to U.S. Pat. No. 3,529,152 to Strange et al., issued Sep. 15, 1970, entitled "infrared Radiation Detection Device for a Non-Dispersive Selective Infrared Gas Analysis System", incorporated by reference herein for its discussion and disclosure of a similar analog infrared detector. Reference can also be had to U.S. Pat. No. 4,008,394 to Risgin et al., issued Feb. 15, 1977, entitled "Gas Analyzing", incorporated by reference herein for its disclosure of an analog infrared sensor using a chopper with multiple detectors to measure a plurality of gases.

Figure 2:
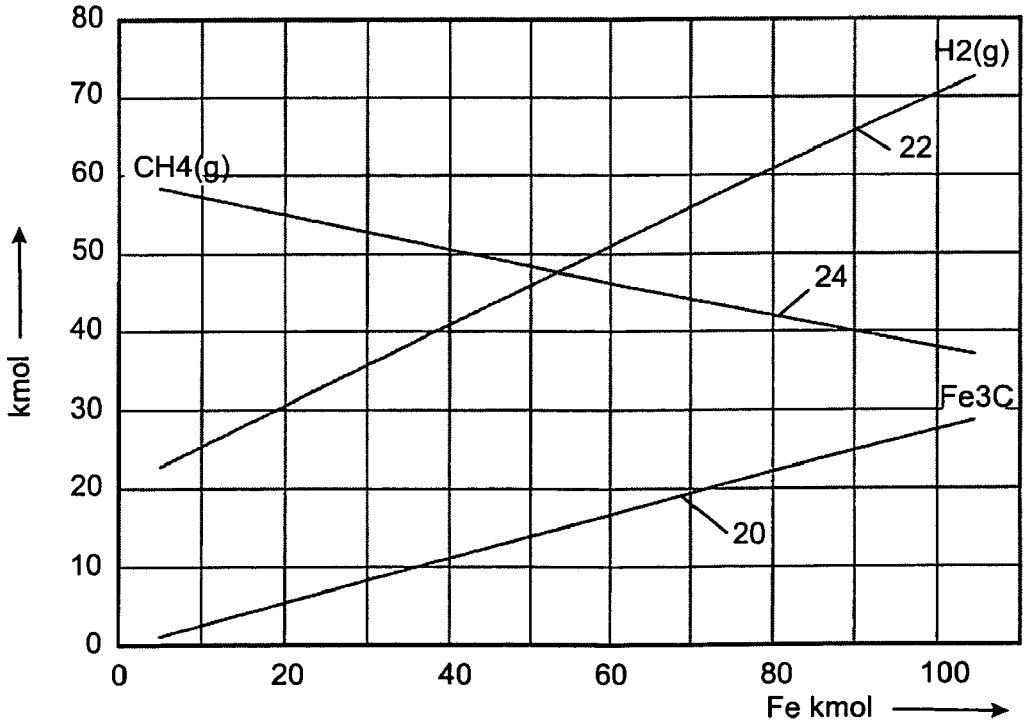
FIG. 2 is a computer generated graph similar to FIG. 1 showing the use of cyclohexane and hydrogen to carburize steel.
Figure 3:
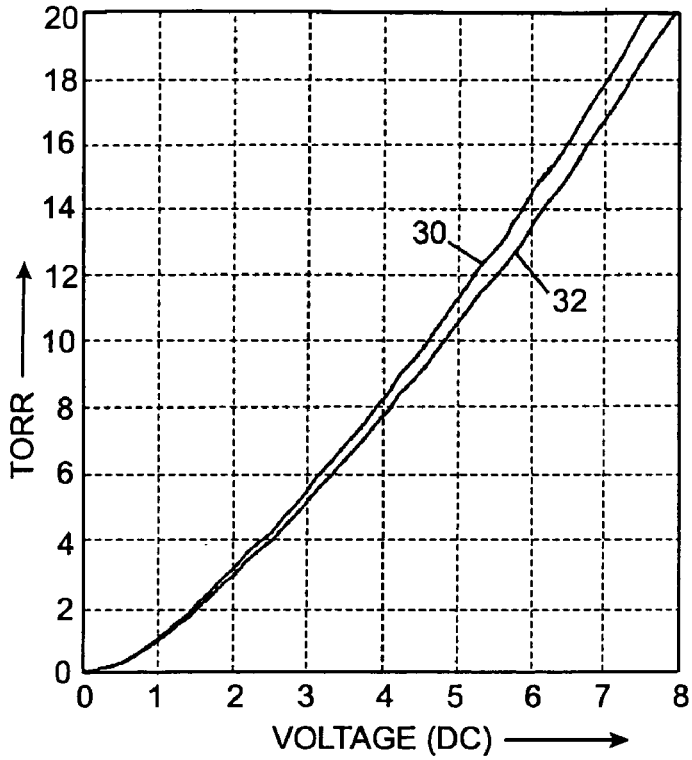
FIG. 3 is a graph showing voltage generated by the infrared sensor at different furnace vacuum levels.

Referring now to FIG. 3, there is shown a graph of pressure in torr plotted on the "y" axis which is the pressure of the furnace vacuum chamber and a voltage signal read from the prototype infrared sensor plotted on the "x" axis. Two traces are plotted designated by reference numerals 30 and 32. The plots are the electrical signals generated by two different transducers used in the vessel pressure sensor having two different ranges. Plot 30 had a higher transducer range than the sensor reading designated as plot 32. Each plot represents the electrical signal (x-axis) generated by the sensor when the furnace chamber was completely filled with methane gas at the pressure shown on the "y" axis. As the pressure is lessened, more molecules of gas can occupy the furnace chamber so FIG. 3 indicates that the infrared sensor can detect the concentration of methane in the furnace chamber. As indicated in FIGS. 1 and 2, when the carburizing process continues with the cyclic hydrocarbon gas more methane is generated as the workpiece surface become saturated with carbon. What has been observed is that the electrical signal of the infrared detector outputs the concentration of methane present in the furnace chamber notwithstanding the presence of other gases in the furnace chamber. For example, FIG. 3 indicates that if the infrared sensor generated a voltage signal of about 2 volts, the furnace chamber would be completely filled with methane gas at 3 torr. If the furnace chamber were carburizing the work at 10 torr and the infrared sensor outputted a voltage signal of 2 volts, then 30% (3/10) of the gas present in the furnace chamber will be methane and 70% of the gas will be something other than methane. If the detector signal was 4.5 to 5.0 volts and the furnace chamber was at 10 torr, then all of the gas in the furnace chamber would be methane. This relationship holds throughout the vacuum carburizing ranges of the present invention and provides the underpinning for a quick and easy control to determine the status of the carburizing process when using cyclic hydrocarbons and more particularly, when using the 5 and 6 carbon sided naphthene rings of the preferred embodiment. Further, it should be noted that it is easy to calibrate the sensor. Zeroing of the instrument and electronics is accomplished while the furnace is under a hard vacuum (no gases are present) and spanning of the instrument is accomplished by filling the furnace with methane to a set furnace pressure (typically 10 torr) and adjusting to 5 volts DC output.

In addition to comparing the output signal voltage of the NDIR sensor to the actual vacuum levels being run in the furnace, the signal must also be modified to account for the carburizing temperature. As shown in FIG. 4, 2½ liters per minute of cyclohexane and 2 liters per minute of hydrogen were metered into the furnace chamber to perform carburizing cycles at various set vacuum levels. In particular, 4 to 5 tests at various vacuum levels were conducted at fixed carburizing temperatures of 1800° F. to generate trace 34, 1700° F. to generate trace 36, and 1600° F. to generate trace 38. The electrical signals plotted are indicative of the methane concentration in the furnace chamber at the end of the carburizing cycle. Pursuant to the discussion concerning the gas composition in the furnace chamber during the carburizing process for FIG. 2, the voltages plotted for traces 34, 36, 38 are maximum methane concentrations in the furnace chamber. Accordingly, the infrared sensor can be used to determine the end of the cycle or to adjust the metering of the cyclic hydrocarbon into the furnace to produce minimum carburizing cycles.

4) Variable Carburizing.

As may be deduced from the discussion thus far, if an excessive amount of hydrogen was present in the vacuum chamber, there could be competing reactions upon cracking of the hydrocarbon ring to form either methane or carbon in the workpiece. This is illustrated in the computer generated graph illustrated in FIG. 5, which shows reduction in $Fe_3C$ with increased hydrogen additions for carburizing at 900° C. (1652° F.). In FIG. 5, the vertical or "y" axis indicates the quantity of "moles" present in the reaction and the "x" axis indicates the quantity of external hydrogen supplied for the reaction. In this graph, the assumption is that there are available 50 "moles" of Fe and 40 moles of cyclohexane. The methane produced in the reaction is indicated by the trace designated by reference numeral 40, the "moles" of iron available for carburizing is shown by the trace designated by reference numeral 42 and the "moles" of iron carbide produced is shown by the trace designated by reference numeral 44. As shown at the right hand portion of FIG. 5, if 250 moles of external hydrogen is supplied, a maximum quantity of methane is produced and a minimal quantity of carbon in the iron results. If the external hydrogen is reduced to 1 mole of hydrogen shown at the left hand portion of the curve, carbon in the iron becomes maximum and methane reduces to a minimum. FIG. 5 shows that it is possible to produce a variable carbon potential in a vacuum furnace, allowing, for the first time, carburizing to proceed in the furnace at set carbon potential limits up to saturation and without the necessity of having to follow the carburizing step with a diffusion step (vacuum without carburizing gas). "Saturation" is used herein in its normally accepted meaning for carburization and means the solubility limit of carbon in the metal. Assuming a sufficiently rich carburizing environment, carburizing temperature affects the solubility limit of carbon in the metal. For example, low-carbon steel can develop a carbon at the surface of about 1.2% at 1650° F. and 1.4% at 1750° F. The ACM line of the iron-carbon equilibrium diagram is a plot of solubility of carbon in austenite with temperature for carbon steels. Most alloying elements will shift the ACM line to the left on the equilibrium diagram.

Another way of depicting what is shown in FIG. 5 is demonstrated by the theoretical plot constructed for the graph shown in FIG. 6. In this graph, the "y" axis is the percentage of carbon deposited on the surface of the workpiece with 100%, meaning that the workpiece is fully saturated with carbon and reducing down to zero at the bottom of the "y" axis. The "x" axis is the ratio of methane to hydrogen present in the furnace chamber expressed as $CH_4/CH_2$. The theoretical trace 46 indicates that as the ratio changes, the amount of $Fe_3C$ produced also changes so that by controlling the methane to hydrogen composition of the gas in the furnace chamber, the carbon deposited in the case of the workpiece can be controlled. As noted in the Background, variable carbon potentials have been produced for gas atmosphere carburizing by controlling the $CO/CO_2$ ratio of the endothermic gas at positive pressures with minimal flow. In vacuum carburizing, the carburizing reaction occurs immediately and as soon as the carburizing medium is introduced into the furnace chamber. Also, there is only a small quantity of gas and the changeover of the gas composition by vacuum is relatively fast. All of these requirements mean that in-situ, fast response sensors are required to control the process.

As noted above, and as of the date of this application, the infrared analyzer has been tested and verified, workpieces have been successfully carburized with only cyclohexane and methylcyclohexane gas in both hot and cold wall vacuum vessels and workpieces have been successfully carburized in both hot and cold wall vessels with hydrogen added to the furnace chamber along with the naphthene hydrocarbons. Vacuum carburization at less than saturation and without diffusion has been successfully demonstrated. It has been found that full saturation carbon can be achieved with hydrogen molar flow rates up to about double that of the flow rate of the hydrocarbon (although a cut-off where saturation cannot be achieved has not yet been established for each of the carburizing gases). Clearly, if hydrogen was flowed into the furnace chamber at molar flow rates six times that of any of the cyclic hydrocarbon gases, carbon saturation would not be achieved at the workpiece surface. The hydrogen flow rate for the 5 and 6 ring cyclic hydrocarbons is a function of the carburizing temperature. Higher carburizing temperatures appear to require less hydrogen. Preferred flow rates are about 0.5 to about 1.5 hydrogen to carburizing gas, and more preferably, at a 1 to 1 flow rate ratio. Pressure is not a limiting factor. Carburizing has occurred with the hydrocarbon gases at vacuum levels of about 20 torr down to vacuum levels as low as 2 torr with satisfactory case carburizing results with little if any carbon soot deposits. It is believed the process with the 5 and 6 sided carbon ring naphthenes will carburize uniformly at pressures of 100 torr or less without producing objectionable quantities of soot.

In general summary, hydrogen addition with cyclohexane is not mandatory, but does give brighter finished pieces and a brighter furnace especially at the lower temperatures. Vacuum carburizing at 1800° F. with no hydrogen addition whatsoever produce completely bright parts that appear silver in color. At 1700° F., the color is a slightly little darker. At 1600° F. and at pressures that are higher, such as 20 torr, the parts will be darker in nature with no hydrogen additions. In this mode, it is still possible to run no hydrogen, or it is possible to simply drop the pressure to 10 or 15 torr, or it is possible to add hydrogen flow, or any combination above. Hydrogen additions raises the brightness level at the lower temperatures or when running at the higher pressures. During these conditions, the parts are extremely bright and silver like in color. Vacuum carburizing at flow rates as low as 0.1 L/M (liters per minute) hydrogen and 2.5 L/M (converted to gas flow) cyclohexane or methylcyclohexane and at 9.5 torr, have produced parts that are bright and silver like in appearance for temperatures 1600° F., 1700° F. and 1800° F. Typically, vacuum carburizing will run at 2 L/M hydrogen with 2.5 L/M cyclohexane for just good measure. Excellent results have been obtained running 2.0 L/M hydrogen and 1.2 L/M cyclohexane. With higher hydrogen flows, it is expected that carburizing can be operated at higher pressures, easily 40 to 100 torr to produce bright parts.

To better define the limits of the invention, the process is believed to work well at pressures as high as 100 torr. The amount of gas that the furnace chamber can hold is a function of the pressure and temperature in the furnace. The carburizing reaction occurs immediately upon introduction of the carburizing case. Before the process starts, it is known from the surface area of the parts and the desired case hardness requirements how much carburizing gas must be eventually supplied the furnace. An overall process time is established based on the diffusion laws noted above which, in turn, depend on temperature and pressure. The rate is then established by dividing the total quantity of gas to be metered by the total process time. If the rate as established is greater than the gas that can be held by the furnace chamber for that pressure and temperature, the pressure can be increased or time increased or temperature dropped. Typically, a pressure is selected (10 torr with or without hydrogen) and the quantity of hydrocarbon required for carburizing is determined to set the process time. Generally speaking, cyclohexane flows in the range of 1 to 2½ liters/mm have been used with the furnace chamber at pressures of about 9.5 to 10 torr.

As of the date of this application, a cost efficient in-situ sensor for measuring hydrogen has not been developed. As noted, a mass spectrometer could be utilized to obtain this measurement but it is not believed practical for the application. While infrared sensors do not absorb hydrogen, other light source sensors, such as monochromatic laser sensors, conceivably could be used in the invention to detect hydrogen. For example, see U.S. Pat. No. 6,366,355 to de Grant et al. issued Apr. 2, 2002, entitled "Real-Time In Situ Multiple Gas Species Sensing Method" disclosing a monochromatic laser sensor for use in heat treat furnaces at positive pressure. The '355 patent is incorporated by reference herein for its disclosure of a laser source suitable for hydrogen detection. Alternatively, mathematically and empirically a relationship based on surface area of the part, case depth, set pressures and carburizing temperatures can result in a mathematical/empirical control based only on the methane concentration sensed by the sensor. The sensed methane concentration can then be used to adjust the hydrocarbon flow to produce the variable carbon potential. That is, if the conditions at the start of the cycle are known, then an expected sensor reading over time can be predicted and the flow of hydrocarbon (or hydrogen) adjusted to achieve the predicted sensor readings. Such an approach has not yet been refined as of the date of this application but it is entirely feasible. It should be recalled that the methane sensor measured the concentration of the methane. From the HSC graphs, the balance is hydrogen. Therefore, hydrogen can be assumed known. The desired values for equilibrium type carburizing have to be obtained to generate a predicted path that the methane sensor will follow. Variable carburizing has been demonstrated to be possible. The control for variable carburizing has not been perfected as of the date of the invention but it is feasible to control the process for a variable carburizing along any of the three lines mentioned. Specifically, this invention does include in-situ measurements of hydrogen and methane to determine that a hydrogen to methane ratio exists in the furnace which ratio establishes a set carbon potential in the furnace chamber as shown in FIG. 6. Specifically, the flow of the carburizing gas (any hydrocarbon gas) or the flow of the hydrogen gas or flows of both gases are varied to establish the desired hydrogen to methane ratio. An in-situ measurement of hydrogen is obtained by a conventional mass spectrometer or any other known device which can measure hydrogen concentration in the furnace chamber. Methane concentration can also be measured in-situ by the mass spectrometer, the infrared sensor or any other known device.

C. The Vacuum System

Figure 7A:
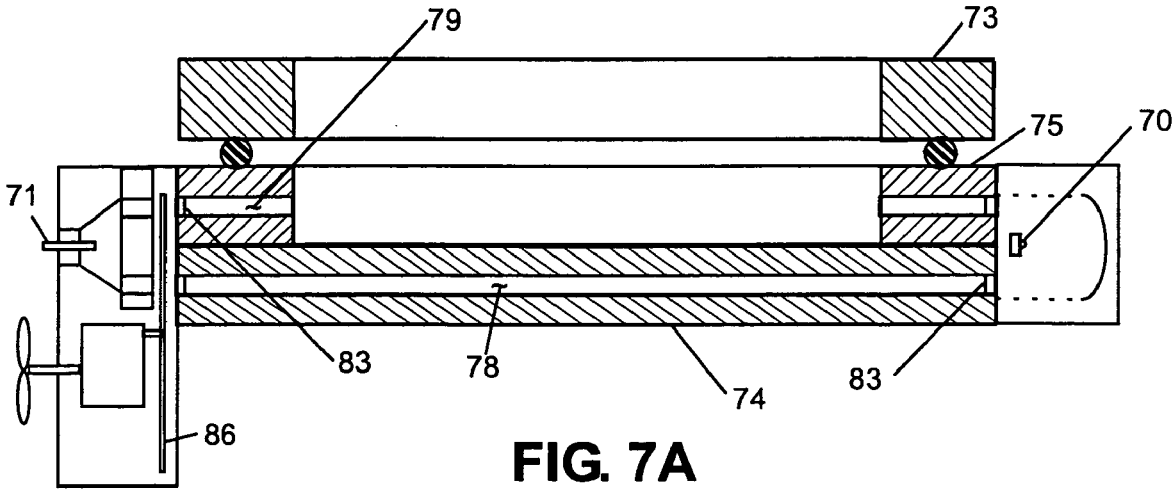
FIG. 7A is a schematic cross-sectional view of the prototype in-situ infrared sensor used to measure methane in the furnace.
Figure 7:
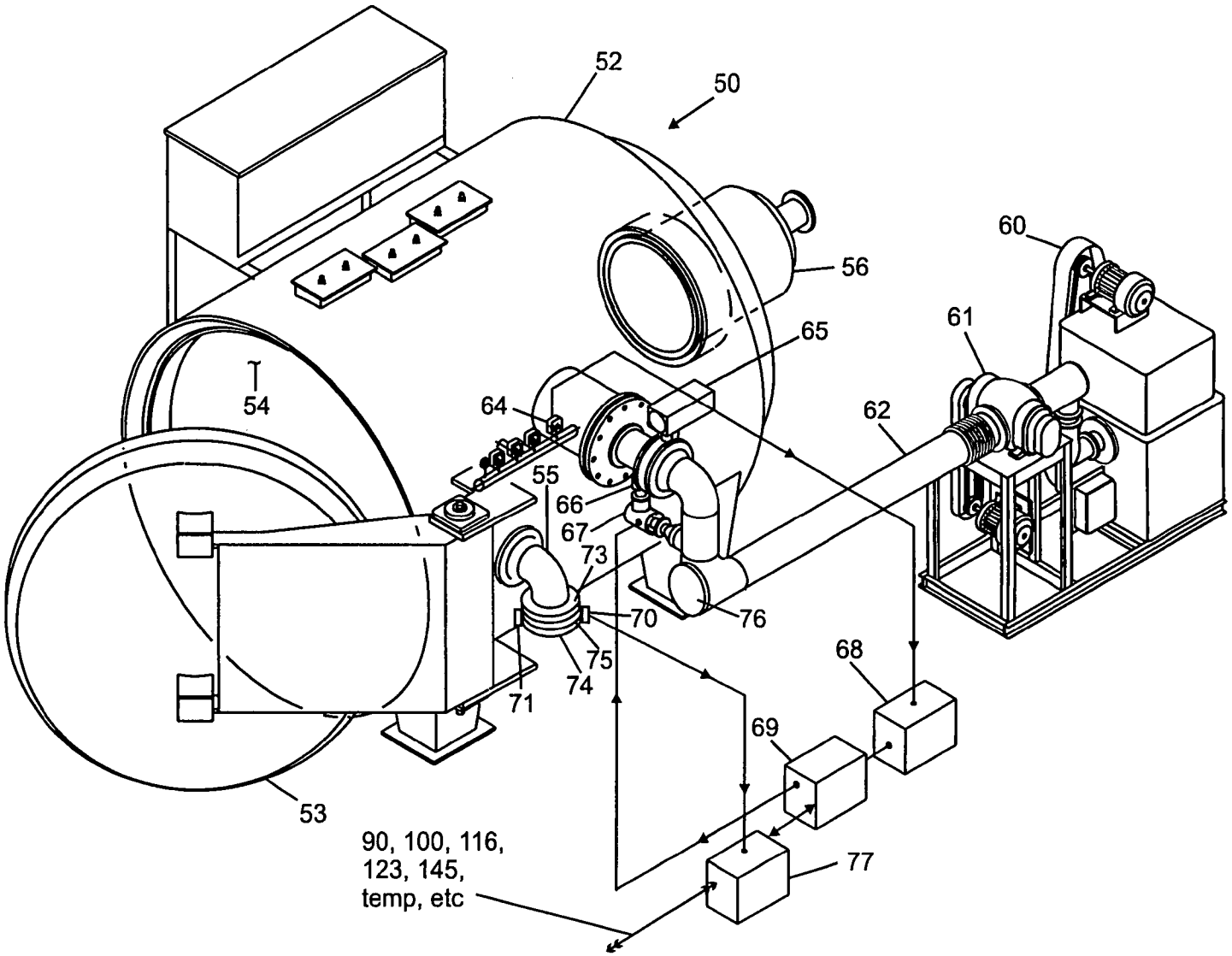
FIG. 7 is a perspective view of a single chamber vacuum furnace with the vacuum connection illustrated.

Referring now to FIG. 7, there is shown a single chamber vacuum furnace 50 which basically comprises a vacuum tight furnace casing 52 (actually a cylindrical casing with one end sealed by a spherical casing) having an open end which is vacuum sealed by a door 53 to define a vacuum tight furnace chamber 54 or pressure vessel therein. Mounted to the spherical end of furnace casing 52, is a fan 56 for gas quenching. The furnace illustrated is a cold wall type and has furnace insulation secured to the inner chamber assembly of the casing. Fan 56 is used for gas quenching of the carburized parts after the carburizing cycle. The furnace design illustrated was chosen for its simplicity. As is well known, the furnace can be provided with a separate liquid quench chamber, a vestibule for loading and unloading the work, special doors between chambers, etc. and the designation "vacuum furnace" as used herein is intended to cover all known variations of a vacuum carburizing furnace including the plasma or ion-glow furnaces.

The vacuum system for furnace 50 includes a pump 60 and a pump blower 61 connected to a vacuum exhaust duct 62 leading into furnace chamber 54. Within furnace chamber 54 is a pressure switch or vacuum gauge 64. Outside furnace chamber 54 is an evacuation valve 65 (i.e., EVAC valve), a tight shut-off valve 66 and a choker valve 67. The control includes a pressure transducer electronic readout 68 and a PID microprocessor loop controller 69. As shown, pressure transducer 64 is wired to optional pressure transducer readout 68 and the choker valve is controlled by PID controller 69. The choker valve is actually in a by-pass vacuum leg. When the carburizing gas is metered the EVAC valve 65 is closed and choker valve regulates the vacuum in the furnace chamber so that gas is drawn out at the same rate it is admitted into the furnace. This is entirely conventional.

Also shown in FIGS. 7 and 7A is an infrared detector 70 and the infrared source 71 for detector 70 which is shown connected to DataVac controller 77. In the prototype embodiment, an auxiliary vacuum duct 55 exists which is provided with an annular flange 73. A closed circular plate 74 was welded vacuum tight to an annular sensor flange 75 which, in turn, was bolted, vacuum tight, to annular flange 73. In closed circular plate 74 there is drilled a through passage 78 which functions as the reference chamber for the infrared sensor. A similar overlying passage 79 is drilled in annular flange 75 and both passages are provided with sapphire windows 83 at their ends (4 total) which are diametrically opposed. Sapphire windows 83 are provided with 0-ring seals and function as a vacuum barrier for sensor, filters and source while sensitizing the methane wavelength. Mounted external to the windows and circular plate 74 in annular flange 75 is infrared source 71 which include the fan and chopper 86 as explained above and which is a dual beam source in the sense that infrared light is directed through the passages in both closed circular plate 74 and annular flange 75. At the opposite sapphire window is mounted detector 70 which has a parabolic mirror. If multiple gases were to be analyzed by the infrared sensor, for example, the presence of intermediate hydrocarbons such as propene, ethylene, etc., additional detectors 70 could be circumferentially spaced about additional sight passages drilled in sensor annular flange 75 and the detector could be equipped with a single-rotating chopper disk as disclosed in the '394 patent or multiple rotating disks or, alternatively, annular flange 75 could be equipped with reflecting mirrors to transmit the infrared radiation to the circumferentially spaced detectors.

Because furnace chamber 54 is under vacuum, the sensor can be situated anywhere upstream of EVAC valve 65 and choker valve 67 in anything that is in fluid communication with furnace chamber 54 and "in-situ" is used herein in accordance with this meaning. In FIG. 7, there was an additional port in furnace casing 52 which was used for the sensor. Preferably, the sensor is close to furnace chamber 54 but it can be several feet away which will produce a minor delay in response time. It is to be noted because furnace chamber 54 is under a vacuum, adding a "dead-end" passage to the furnace chamber "proper" simply increases the size and configuration of the furnace chamber to include the added passage. Because the vessel is under vacuum, the atmosphere in the added passage is the same as that in the furnace chamber "proper". In conventional furnaces at positive pressures, the composition of the furnace gas in an added duct is most probably not that of the atmosphere in the furnace chamber. The sensor can not be mounted downstream of the EVAC valve or choker valve such as in vacuum exhaust duct 62 because the temperature is dropping, pressure is much lower and the flow is not steady. While furnace chamber 54 is observed as clean, the exhaust duct 62 has been observed to contain carbon deposits. The temperature drop downstream of the evacuation valves is believed to cause the carbon in combination with the relatively small size of the exhaust duct. An access cover 76 with a removable liner in the exhaust duct is contemplated in the commercial application.

Also shown in FIG. 7 is a master controller 77 which communicates to and from PID loop controller 69. Master controller 77 allows the operator to set process variables and reads out operating data in visual or print form, allows the operator to intervene, sounds alarm warnings, and in a more sophisticated version, can adaptively tune itself, collect and perform trend analysis, provide SPC functions, etc. For the vacuum system disclosed in FIG. 7, master controller 77 will provide PID controller 69 with the desired vacuum levels which PID controller 69 will implement and, similarly, mass flow controller 100 will be controlled by master controller 77 with the flow values that mass flow controller 68 will implement as well as controlling injectors 125 by pulse signals to injector contacts 145. Additionally, master controller 77 will send command signals to, and receive monitoring signals from, the temperature controllers which the furnace is equipped with, insure the interlocks are properly activated, control the valving for metering of the—gases, control the firing of the injectors etc. In the preferred embodiment, assignee's DataVac® controller performs these functions.

The pressure control loop shown in FIG. 7 is quite simple. Choker valve 67 is placed between vacuum pump 60 and furnace chamber 54. Its purpose as noted is to restrict the pump and let the pressure rise. That is, if hydrocarbon gas is flowing and evacuation valve 65 is closed, the pressure in furnace chamber 54 will eventually reach atmospheric pressure. Choker valve 67 simply positions itself to allow vacuum pump 60 and blower 61 to take away the gas from furnace chamber 54 at the same flow rate as that at which gas is introduced into furnace chamber 54.

The process cycle, whether the hydrocarbon medium is metered as a gas or liquid, is a follows:

1) Load furnace and close door 53.

2) Make sure pressure control loop 69 is set for maximum to fully open evacuation valve 65 to speed pump down rate.

3) Start DataVac® controller recipe.

4) Pump down to 35 microns. Any value from 10 to 200 microns is acceptable and common. Heat the work to 1700° F., or any desired carburizing temperature.

5) Soak load at temperature to assure uniform carburizing.

6) If gas injection is used (see FIG. 8), start up vaporizer. Vaporizer pressure set point is 20 psig and temperature is 200° F.

7) If gas injection is used, make sure vaporizer is stabilized for pressure and temperature.

8) Set PID controller 69 to 9.500 torr or any other desired pressure set point.

9) Pressure control system closes choker valve 67, attempting to raise furnace pressure from 35 to 75 micron range to 9.500 torr. The system will not accomplish this until hydrocarbon gas begins to flow.

10) Start carburize portion of cycle by opening shut-off valve for gas injection shown in FIG. 8, or start liquid injection (as explained below). DataVac® performs this automatically whether gas or liquid hydrocarbon is injected.

11) Set mass flow controller 100 and injector 125 (if liquid is injected) via DataVac controller 77 for desired gas flow.

12) Carburize for a set time to accomplish desired case depth.

13) Turn off carburizing gas flow.

14) Set PID controller 69 to "0" or maximum opening of choker valve 67.

15) Begin diffuse cycle.

16) Once diffuse cycle is complete, DataVac® controller 77 will lower temperature to pre-quench temperature, typically, 15500 F.

17) Gas quench, oil quench, or slow cool.

18) Cycle complete.

The system is more automatic if a liquid injector system is used since vaporizer temperature and pressure control loops are eliminated.

Pressure transducer 64, in the preferred embodiment, is an MKS transmitter that is a diaphragm type transducer that measures absolute vacuum or furnace pressure levels regardless of gas chemistry in the furnace. Vacuum sensors built around temperature changes within the sensor such as a thermocouple gauge tube or pirani gauge will not work without mathematical compensation, but the MKS transmitter works fine and is used routinely in assignee's ion carburizer and ion nitrider furnaces. A 0 to 10 vdc signal from transducer 64 goes to optional readout device 68 and on to PID controller 69 which, in one embodiment of the invention, is a Honeywell UDC 3000 controller or equal. This loop could easily be done in the DataVac® controller or a PLC controller. The UDC-3000 opens choker valve 67 to move down in pressure toward 35 microns and closes choker valve 67 to move up in pressure toward atmospheric pressure. If there is too much flow into the vessel, the controller will open the choker and allow the pump to pull the vacuum back down. Likewise, if the flow becomes too low into the furnace, choker valve 67 closes and pressure moves back up.

D. The Hydrocarbon Delivery System

Cyclic hydrocarbons, and particularly the preferred embodiments of naphthenes having 5 or 6 sided carbon rings, are supplied in liquid form. As noted above, commercial cyclohexane comes in a very pure form of about 99.9% with the other 0.1% contamination being other hydrocarbons. This is to be contrasted to acetylene and other unsaturated aliphatics which have purity in the range of 99.6% and contain impurities such as water vapor and air which may also include traces of $CO_2$ that are considered undesirable in the vacuum process. This means that the purity of the cyclohexane helps insure that reproducible control results can be obtained. Also, while 5 or 6 carbon ring naphthenes may be deemed to be a hazardous material according to Federal regulations as are many carburizing gases (and safety provisions must be complied with), it is well known that the stability and lack of reactivity of the naphthenes present less of a danger than acetylene which is highly reactive and has an explosive nature. Actually, cyclohexane has relatively good NFPA (National Fire Protection Association) ratings. The compound is customarily used as a camp stove fuel and also as a mild solvent. Compared to other carburizing choices, cyclohexane is very safe, scoring a "1" for health, "3" for flammability, and "0" for reactivity. Methane scores relatively worse at "1" for health, "4" for flammability, and "0" for reactivity. Carbon monoxide scores worse at "2" for health, "4" for flammability, and "0" for reactivity, while acetylene scores "1" for health, "4" for flammability, and "3" for reactivity. The lower the NFPA number the better. Cyclohexane, when released to the atmosphere, is considered a hazardous air pollutant by the EPA. It is believed according to the theoretical discussion, that cyclohexane either converts to methane during carburizing or thermally decomposes inside the furnace chamber, thus presenting minor impact levels to the environment.

There are conceptually four ways in which the liquid naphthene can be used in the carburizing process and this invention, in its broader sense, contemplates using any of the four metering methods discussed below although one is definitely preferred. The four approaches for using naphthene in liquid form are as follows:

A) Direction injection via a simple control valve into the vessel.

B) Vaporizing the liquid with an external heater. This approach has been used on the assignee's Nanodyne methanol disassociator orders presently running in the field.

C) External vacuum vaporizing.

D) Small time pulse injection charges.

The following outlines the methods for introducing the liquid naphthene hydrocarbon into the furnace:

A) Direct injection via a control valve is by far the simplest in regard to hardware. A small needle valve allows a low pressure liquid supply to be admitted into the furnace. Directly inside the furnace, a hydrogen source flow is added in a heated pipe by the furnace heating system. The connection between hydrogen and the naphthene is made before entering the hot zone proper. It is extremely important for the combined hydrocarbon and hydrogen to travel together in the heated pipe before contacting the work. The draw back to this simplest method is a rather rapid expansion of the liquid flow due to the low pressure around the liquid and bursts of gas that will be generated. These bursts may cause the furnace pressure to swing up and down and cause the flow of hydrogen, which is constant to vary the hydrocarbon to hydrogen ratio. The gas mix level of consistency may be varying over time. This arrangement is not preferred for the naphthenes of the preferred embodiment.

B) Vaporizing the liquid with an external heater operating about 160° F. to 220° F. (depending on the hydrocarbon selected), will generate a gas and therefore be easier to mix with the hydrogen in the furnace. Mixing of the two gases is done outside the furnace completely and passed into the vessel through one connection or can be mixed inside the furnace. The heater does require additional hardware and heat wrapping of the pipe leading to the furnace is typically required.

C) External vacuum vaporization does not use a heater, but simply allows the furnace vacuum to travel back to a surge tank where the liquid is allowed to enter the bottom of the expansion tank through an evaporation control needle valve. Depending on the liquid used, the vapor pressures are in the range of 25 to 95 torr. By keeping the pressure in the surge tank to levels that are lower, the small amounts of liquid entering the tank through the bottom located expansion valve will cause these drops of liquid to immediately vaporize due to the low torr level in the tank. The flow of gas then goes to the furnace under vacuum and no heater or heat wrapping is required. Flow of liquid into the tank would be controlled by a separate valve between the liquid and the evaporation tank. The liquid tank would be blanketed with up to about 4 psig nitrogen or argon to keep the tank contents free of oxygen and to allow make-up of the volume of the tank created by the usage of the gas.

D) The fourth method, which is the preferred embodiment of the invention, uses a simple, low cost automobile fuel injector which is suitable for handling hydrocarbons of the inventive type. A supply pressure ranging from 5 to 50 psi from a small positive displacement fuel pump and fuel regulator is used. These components are fairly inexpensive and are readily available and have demonstrated excellent reliability. The fuel injector will time pulse on for a period of time on the order of milliseconds and inject small shots of liquid hydrocarbon directly into a heated pipe along with a constant hydrogen flow from a separate mass flow control valve. The shots of liquid are small enough and under sufficient pressure to allow complete injection without the risk of pressure bubbles and blockages etc., that might occur with method "A" listed above. Increasing the duty cycle of the gas flow pulse to the injector will increase the flow of liquid. Pulses of gas can occur. The duration or pulse would increase from a few milli-seconds for low surface area loads to perhaps 500 milliseconds for high surface area loads at a frequency of every second to longer periods, say every 15 seconds or short periods, say ⅓ of a second. Injecting more often will also allow more volume of hydrocarbon to be added to the system.

For consistency in terminology, "metering" means introducing the cyclic hydrocarbon into the furnace in any form and "injection" means introducing the cyclic hydrocarbon in liquid form to the furnace. "Metering" therefore includes "injecting." "Injecting" however, as used herein, precludes or does not cover the use of any valving arrangement which regulates the flow of gas to the furnace. Injecting can be accomplished by a fuel injector or a liquid pump with appropriate valving.

1) The Gas Metering System.

Figure 8:
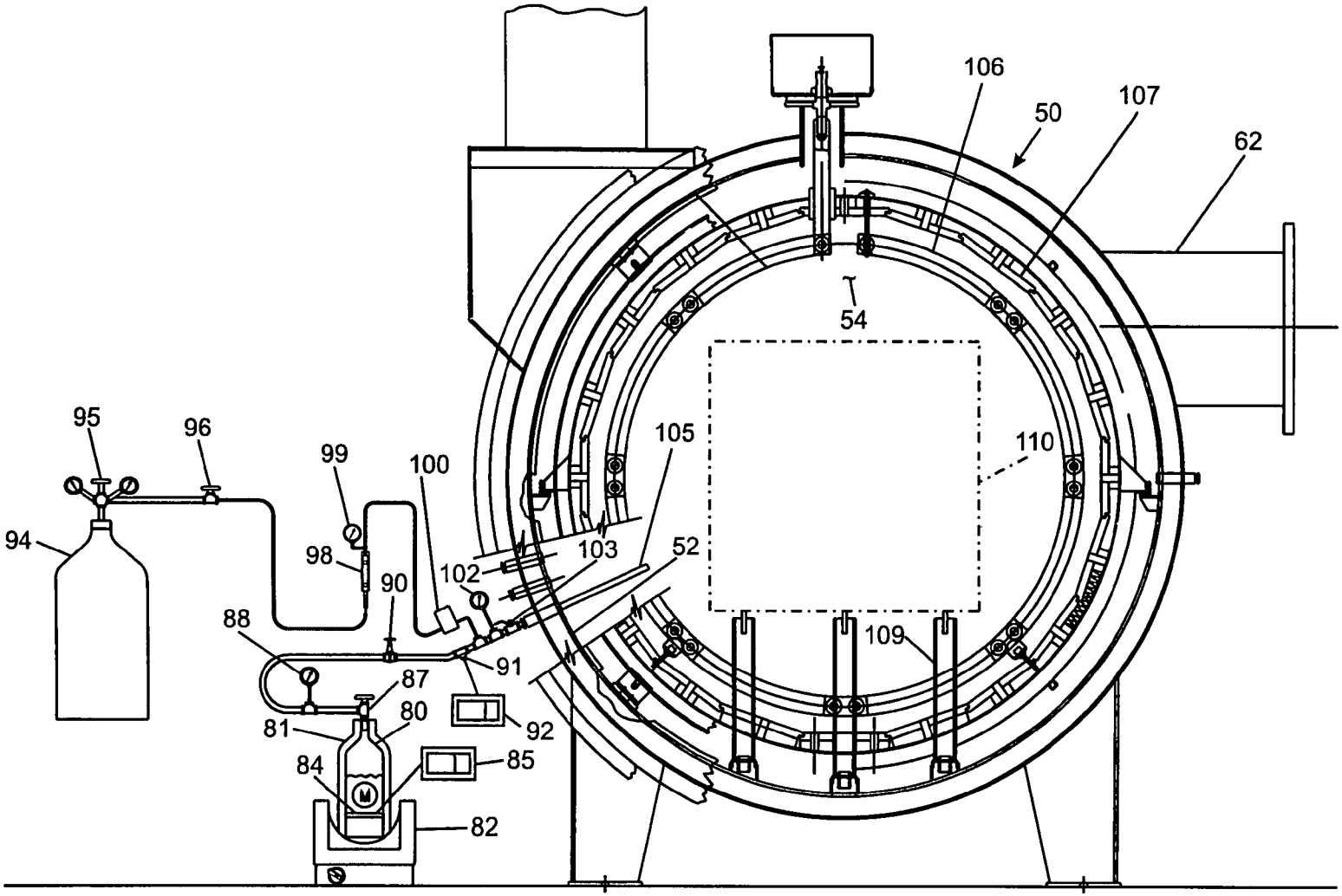
FIG. 8 is a cross-sectional view of an electrically heated cold wall vacuum furnace illustrating a gas injection of carburizing gas of the present invention.

Referring now to FIG. 8, there is shown one embodiment of the invention illustrating one way to meter 5 or 6 carbon ring naphthenes as a gas to furnace chamber 54. In the embodiment of FIG. 8, cyclohexane in liquid form is placed in a tank 80 that is insulated as at 81 and tank 80 is placed in a vaporizer heating source 82 which preferably, is an adjustable electric heater. In the vaporizer is a tank thermocouple and clamp 84 with a temperature readout indicator designated by reference numeral 85. There is a tank shut-off valve 87 and downstream therefrom, a tank pressure gauge 88 and downstream thereof, a mass flow control valve 90. Downstream of mass flow control valve 90 is a mass flow thermocouple 91 connected to a temperature readout device indicated by reference numeral 92. Between mass flow thermocouple 91 and mass flow control valve 90, the ⅜" steel tubing is wrapped in a high density heat tracing tape and between mass flow control valve 90 and tank shutoff valve 87, the ⅜" stainless steel tubing is wrapped in a low density heat trace tape.

There is also provided a hydrogen supply cylinder 94 containing gaseous hydrogen. Mounted to hydrogen cylinder 94 is a hydrogen pressure regulator 95 and downstream therefrom is a first hydrogen flow control valve 96. Downstream therefrom is a hydrogen flow meter 98, a hydrogen flow meter pressure gauge 99, and downstream of pressure gauge 99 is a hydrogen mass flow controller 100. The hydrogen is then T'd into the cyclohexane line and downstream of the hydrogen "T" is a pressure gauge 102 (zero to 30 inches vacuum) and a manual shut-off valve 103. The cyclohexane/hydrogen gas line then passes through furnace casing 52 where it is sealed vacuum tight with a lance 105 where the gas is metered into furnace chamber 54.

Furnace chamber 54 has electric heating elements 106 and is of a cold wall design with furnace insulation 107 pinned to inner chamber housing. Also shown in FIG. 8 are hearth supports 109 which support the work typically placed as loose pieces in a work basket or tray indicated by dot-dash line 110.

In operation of this system, it should be noted that liquid cyclohexane boils at about 176° F. but since pressure in tank 80 is about 20 psig to 40 psig, temperatures up to 200 to 220° F. are acceptable. The cyclohexane cylinder 80 is an aluminum gas cylinder about 4" in diameter and 16" high with shut off valve 87. The cylinder is intended to be used as a gas cylinder under pressure. About 2.5" off the bottom, a thermocouple 84 is attached with a hose clamp. Tank temperature is kept above 200° F. and always under 250° F. and tank temperature is adjusted to keep outlet pressure around 20 to 22 psi and never over 40 psig. The cylinder was filled with various amounts of liquid from 500 ml to 1900 ml. The liquid level did not have any influence on tank temperature and pressure unless the tank was running out of cyclohexane. The remainder of liquid in tank 80 after testing was used to determine usage. If 480 ml of liquid was used in sixty minutes, it was concluded that the tank delivered 105 liters of gas vapor (multiple ml times 0.220 to get liters of gas vapor). Therefore in one hour, 105 liters divided by 60 minutes established a gas flow rate equivalent to 1.76 l/m.

The tank, once filled, was charged with nitrogen to 20 psig, and recharged ten times after venting to flush oxygen from the tank. Tank pressure limits were 50 psig absolute maximum and a minimum was set at 17 or 18 psig. Typically tank pressure is between 20 to 22 psig once the nitrogen is bled off. With the nitrogen charge, tank pressure is around 40 psi initially.

The tank was covered with Kaowool insulation 81 to keep in heat, and heater was set to thermocouple reading 85 and pressure gauge reading 88. Once stabilized, temperature and pressure remained constant.

Typically, the vaporizer was actuated 30 to 60 minutes before needed for carburizing. The $N_2$ is bled off early on while the load was still cool. In commercial production, tank 80 would be charged with argon to be 100% sure no nitriding could take place, but the argon is only for the "purist" of final testing. It is believed the $N_2$ is inert and is lost early on and does not at all influence the hydrocarbon. However, at 1900° F. and above, there is some remote possibility of nitriding.

The piping from the cylinder was ⅜" stainless and was heat traced with two different heat tapes. The tape up to the flow control valve 90 was 4' long and covered a long distance. The heat tape down stream of the micro flow control valve 90 was 24" long and covered a short distance and was packed tighter. This area caused great falls in temperature when flowing vapor. For example, an up steam gas vapor of 245° F. could plunge in a couple a seconds to 40° F. Note that cyclohexane has a freezing point of about 40° F. For this reason, commercial applications of this embodiment would use methyl cyclohexane which has a much lower freezing point of about −197° F. Also, it has been determined that a blend of 20% methylcyclohexane and 80% cyclohexane will substantially reduce the freeze point, so that commercial applications may formulate a blend of preferred hydrocarbons. Heat tape would be used in any event.

Control of flow is obtained by watching the temperature of thermocouple 91 at readout 92. The gas vapor before control valve 90 is around 230° F. due to vaporizer heat and heat tape. Once passing through control valve 90, the temperature dropped as a function of flow. The greater the flow, the lower the temperature. Typically, flow control valve 90 is adjusted to about 195° F. and more flow is added if the temperature went over 210° F. and closed down if the temperature dropped under 190° F. or so. In the beginning of the testing, the flow control valve was constantly adjusted in response to any variation. Later on, the valve was left set unless temperature trended up or trended down.

After processing, the balance of the liquid is measured to determine flow rate and later to assure flow rates were correct. They were always correct. The remaining cyclohexane balance was always clean (as compared to benzene). This demonstrated that the cyclohexane was stable and its composition did not change under heat of the vaporizer.

The above process worked as described without adding hydrogen. Later, hydrogen cylinder 94 was added and its flow rate adjusted by hydrogen mass flow controller 100 and pressure by pressure regulator 95 and first valve 96 to values approximately equal to or less than the psig of the cyclohexane so that backpressure on valve 90 was not present.

Several tests were made adding hydrogen to the cyclohexane. In one series of tests, three liters/minute of hydrogen was added to 1.76 l/m cyclohexane. The 8620 carbon bars were fully carburized to the expected case depth of 0.020" and had a final surface carbon of 1.24% C instead of the typical 1.30% C and the 1.31% C that were obtained on the cyclohexane only tests. The visual appearance of carbon bars as well as the furnace interior was cleaner with the hydrogen additions. The electric heating elements appeared somewhat silvery, but, no graphite erosion was apparent. Note that the gas system constantly delivered the carburizing gas to the furnace.

2) The Liquid "Fuel Injection" System.

Figure 9:
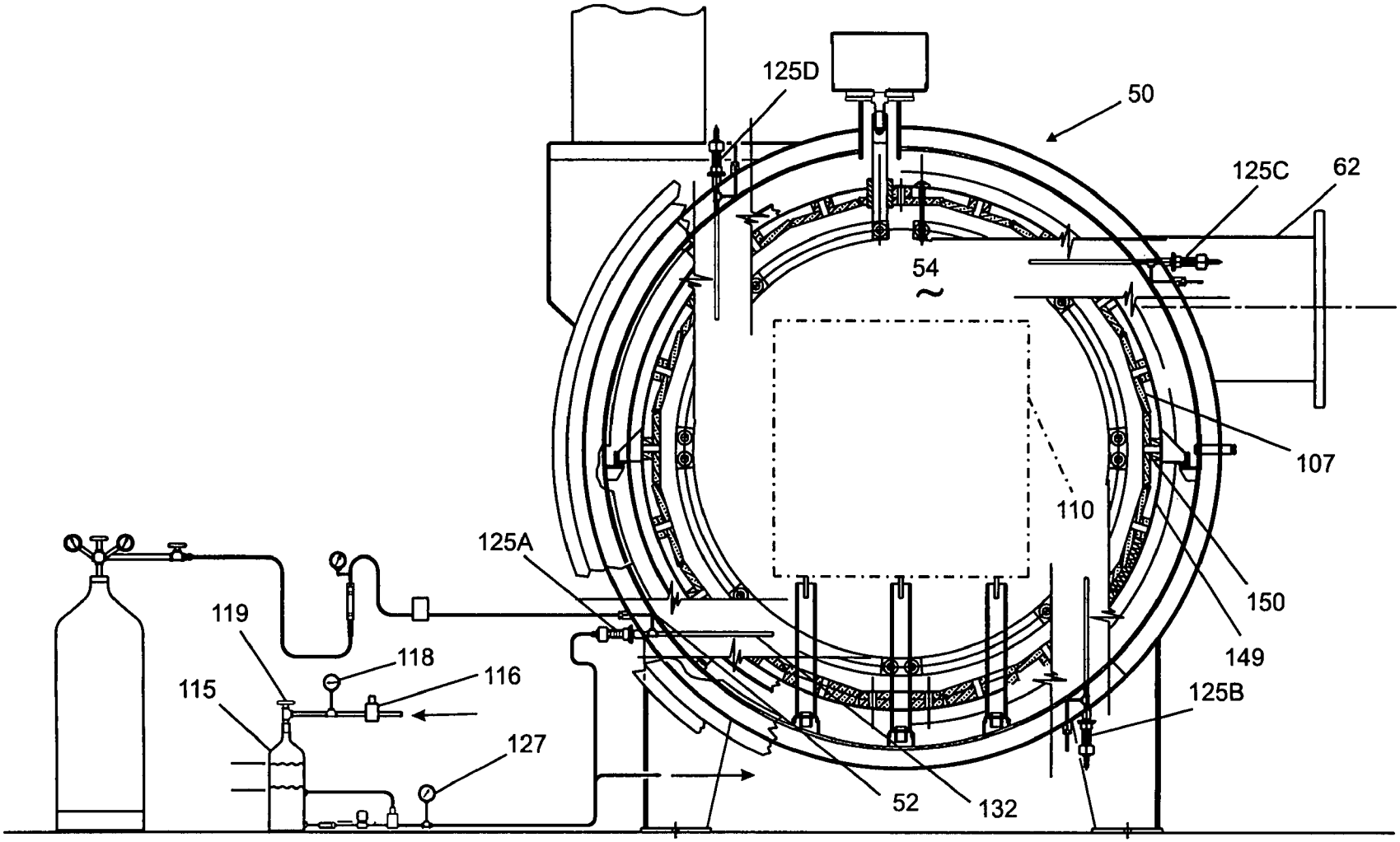
FIG. 9 is an illustration of a cross-section of the vacuum furnace illustrated in FIG. 2 but modified to illustrate injection of the carburizing medium in liquid form to the carburizing furnace.
Figure 9A:
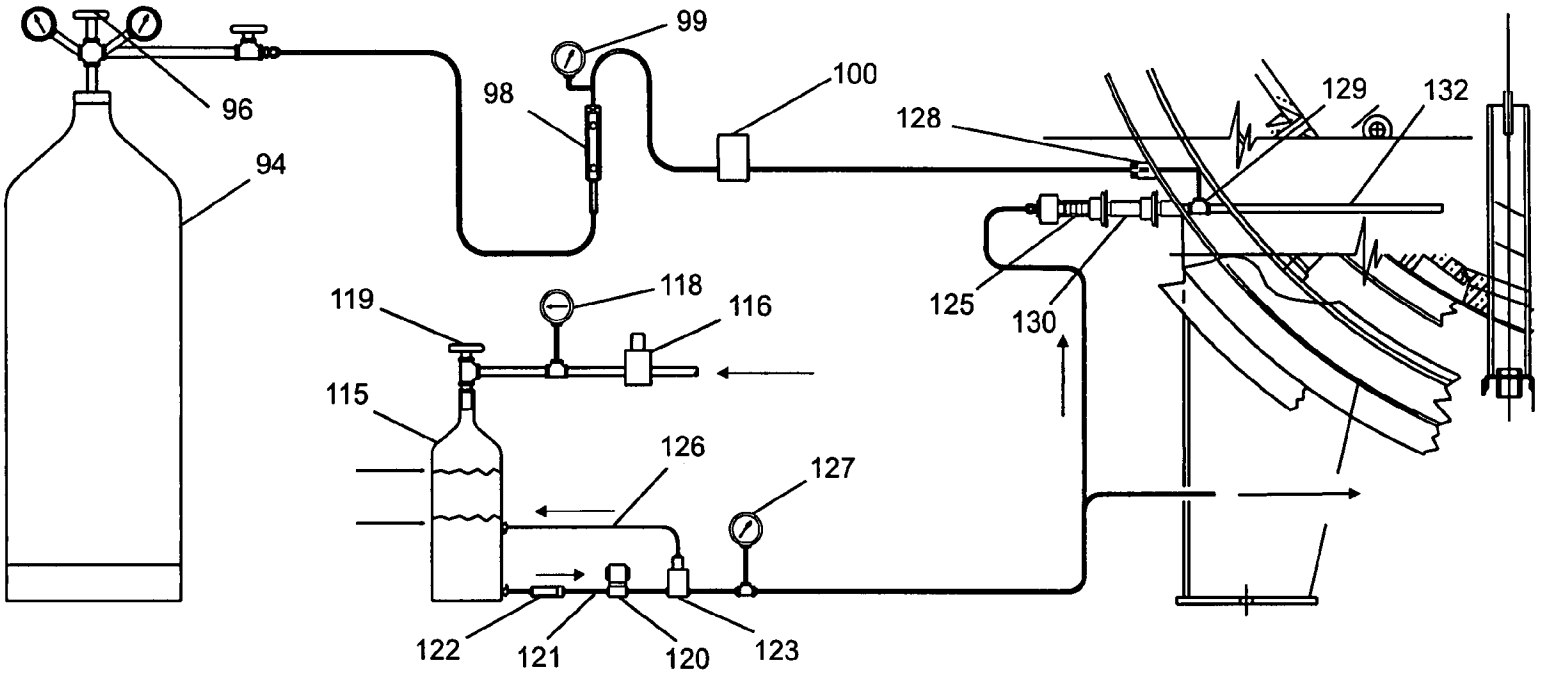
FIG. 9A is an expanded schematic view of the liquid injection system illustrated in FIG. 9.

Referring now to FIGS. 9 and 9A, there is shown a naphthene liquid delivery system. Because many gases used in heat treat processing are supplied in bottled liquid form, there can be a semantical question as to the meaning of a liquid delivery system since the inventive liquid delivery system delivered the carburizing medium as a vapor in furnace chamber 54. Therefore, as used herein, liquid delivery system means that the carburizing medium in a liquid hydrocarbon form is metered as a liquid to the furnace chamber and remains as a liquid throughout the delivery system up to a point or a position which can be defined as being adjacent to the furnace casing. According to this definition, the vaporization of the liquid hydrocarbon to a gaseous hydrocarbon can occur either on the inside of the furnace casing or at a point adjacent the outside of the furnace casing. The flow of the carburizing medium to the furnace is controlled with the carburizing medium in a liquid form. This distinguishes from the prior art which uses bottled gas supplied in liquid form because the liquid when leaving the bottle is a gas which is remote from the furnace and the gas is regulated, typically by a simple mechanical flow meter. This also distinguishes from some plasma applications which literally pulse the gas to be ionized into the furnace chamber by solenoid actuated valves. The solenoid valves control a gas and not a liquid.

In FIG. 9, and as best shown in FIG. 9A, commercial grade naphthene is poured into a hydrocarbon cylinder 115 until it is full, indicated by the top line shown in the drawing (with the bottom line indicating the minimum hydrocarbon level or an empty bottle). Hydrocarbon cylinder 115 is pressurized by a blanket of inert gas such as nitrogen or, preferably argon if potential nitriding at higher carburizing temperatures is a concern. The inert gas is supplied to a pressure regulator 116 typically having an inlet pressure of 150 psig and an outlet pressure of 2 psig. The inert gas passes by a pressure gauge 118 (0 to 10 psig) through a shut-off valve 119 to provide a gas blanket on top of the liquid hydrocarbon in hydrocarbon cylinder 115 at a slight pressure. An inert gas pressure relief valve may also be fitted to the tank in the event the inert gas regulator is defective. A pump 120 draws liquid hydrocarbon out of hydrocarbon cylinder 115 through an outlet line 121 at the bottom of hydrocarbon cylinder 115, the liquid passing through a fuel filter 122 before reaching pump 120. A three-way Mallory pressure regulator 123 or equal make or design downstream of fuel pump 122 directs liquid hydrocarbon to a fuel injector 125 (or a plurality of fuel injectors) or to a return line 126. A 0 to 5 bar pressure gauge 127 is provided for verification and control purposes. As described thus far, this is one of the liquid delivery systems considered for the prototype fuel injector system when only naphthene is used as the carburizing medium and follows the fueling concept used to operate automotive fuel injectors.

In this embodiment, hydrocarbon cylinder 115 is not excessively pressurized by the blanket gas (nitrogen or argon) which is under 14.7 psig. The purpose of the blanket gas is to keep air and moisture out of the system. The inert gas does this and also makes the cylinder safe. Because pressure is less than 14.7 psig, cylinder 115 does not need to be an ASME pressure coded storage tank. Also, pressure regulator 123 is downstream pressure compensated and delivers constant flow at 10, 20, 30 torr, etc. The embodiment depicted in FIG. 9 is preferred as the delivery system for multiple vacuum furnace applications. However, the FIG. 9 embodiment does require a pump and a by-pass. An alternative simpler arrangement is to eliminate pump 120, by-pass line 126 and replace Mallory regulator 123 with a two-way regulator. The pressure of the blanket gas is then increased and supplies the pressure to the liquid valved to injector 125. Setting the 2-way regulator (formerly Mallory regulator 123) to 11 psig produces a differential pressure of 25.7 psi across injector 125 which is perfectly acceptable for the pressures at which the furnace operates and allows the blanket gas to be charged into hydrocarbon cylinder 115 at less than 14.7 psig so that the cylinder need not be a pressure codified cylinder while still retaining the safety benefits of an inert gas. There may be a slight variation in pressure of cylinder 115 as the liquid hydrocarbon is depleted but in practice this has not been observed to produce any detrimental results. Pressure variations may be minimized by orientating the cylindrical tank horizontally. If the fuel output range of injector 125, which is 5 to 50 psig, is to be utilized, an ASME pressurized certified cylinder 115 is required for this alternative embodiment. in either embodiment, the liquid naphthene without air or moisture is supplied at a set pressure to fuel injector 125 which injects liquid pulses of naphthene that vaporize into gas and is a gas inside furnace chamber 54.

When hydrogen is to be metered to fuel injector 125, an arrangement similar to that used for hydrogen as shown in FIG. 8 is employed and reference numerals used with respect to FIG. 8 will apply with respect to the liquid injection delivery system shown in FIGS. 9 and 9A. More particularly, there is a hydrogen supply cylinder 94 which meters gaseous hydrogen at a set pressure as controlled by hydrogen pressure regulator 95 and generally at a set flow as controlled by hydrogen mass flow controller 100. Downstream of the regulator and the valves is hydrogen flow meter 98 and hydrogen flow meter pressure gauge 99 and mass flow controller 100 closely regulates the flow of hydrogen. A vacuum sealed fitting 128 is provided for the hydrogen line to enter in a vacuum sealed manner through furnace casing 52 into furnace chamber 54 where the line is T'd into a fitting 129 which, in turn, is affixed to a lance 132 of fuel injector 125.

Figure 9B:
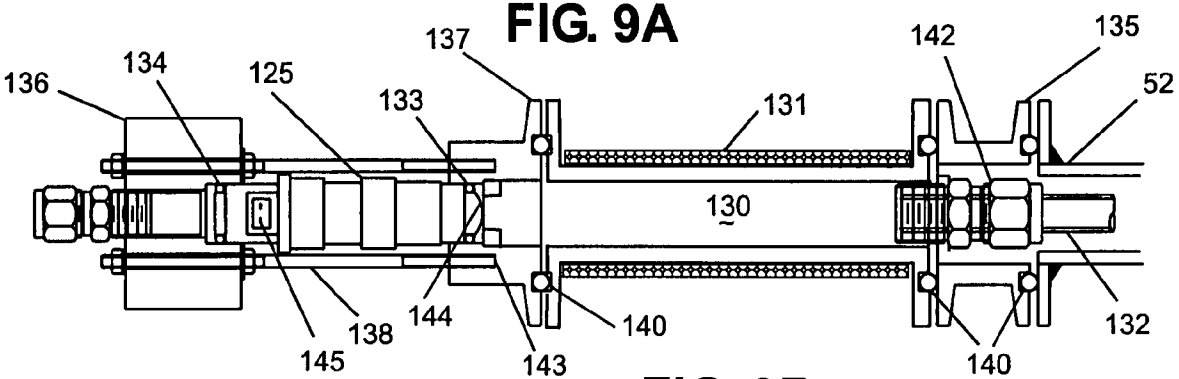
FIG. 9B is an expanded view of the first injector assembly illustrated in FIG. 9.

As best shown in FIG. 9B, fuel injector 125 is supported between front and rear 0-rings 133, 134 which are mounted in bored and polished holes formed in a rear adapter plate 136 and a front adapter flange 137, respectively. Three threaded rods 138 secure the rear adapter plate to front adapter flange 137. Front adapter flange mounts to expansion chamber 130 which, in turn, mounts to a furnace adapter 135 which, in turn, mounts to a flange fitted to furnace casing 52. Several clam-shell clamps (not shown) compress an 0-ring 140 to provide a vacuum tight seal between front adapter flange 137, expansion chamber 130, furnace adapter 135 and furnace casing 140. A special ⅜" Swageloc fitting 142 provides a true sealing fit for lance 132. In the prototype, electrical connectors 145 are wired to gating transistors on a timing circuit for controlling pulsing of fuel injector 125.

Some additional comments are necessary. In the prototype there is a runner between front flange 137 and furnace adapter 135 which is designated a KF runner. This KF fitting is the expansion chamber 130 and mounts to the injector as described. The vaporization of the liquid hydrocarbon to gas causes a drop in temperature. Some cyclic hydrocarbons such as cyclohexane have freeze temperatures of about 40° F. while many naphthenes have lower freeze points with methylcyclohexane having a freeze point of −195° F. As noted, a blend of naphthenes will produce a freeze point in the blend which is a composite of the individual naphthene freeze points, and naphthene blends are suitable for use in the invention. The runner or expansion chamber is sized to allow about a 5 to 1 expansion from liquid to gas. it can be a short as about 4" and as long as desired. The prototype had a diameter of about 0.9" and a length of about 12". The runner or expansion chamber 130 is covered with a heat tape 131 not only to prevent freezing for some of the hydrocarbons but also to simply insure that the vapor of the hydrocarbon stays as a vapor. Note that expansion chamber 130 is outside furnace chamber 54. This is preferred but not necessary and an arrangement can be used where the expansion chamber 130 can be positioned within the furnace, i.e., the furnace wall. Again, the size of expansion chamber 130 is calculated to be sufficient to allow the largest injected pulse to vaporize. A separate expansion chamber may, however, not be needed. For example, the prototype units had lance diameters of ⅜". A larger lance diameter could function as an expansion chamber for the injected pulse. However, the expansion chamber is preferred to avoid the possibility of vaporization at the lance outlet in the furnace proper. As noted above, the large volume of the furnace chamber can be viewed as a reservoir damping pulsations which are not significant since they are timed in milliseconds. Still, for stability of the process, it is preferred that the liquid vaporize into gas before leaving lance 132.

The prototype system used a GM Corvette fuel injector taken from service and has worked without problems carburizing a number of workpieces between 1600° F. and 1800° F. with most of the runs at 1700° F. Liquid flows were initially based on 35 millisecond pulses gated every second and 70 millisecond pulses gated every second. The gas usage repeats extremely close cycle after cycle with the 70 millisecond pulse consuming exactly double that of the 35 millisecond pulse. Timed electrical outputs were calibrated for the prototype on an oscilloscope. Production versions will have high speed clocks using the microprocessor. The 35 milliseconds per second pulse consumed about 5.6 cc of cyclohexane each minute or 336 cc per hour. The liquid usage equates to a gas vapor flow rate of 1.23 liters per minute. Likewise, the 70 ms pulse consumed about 11 cc of cyclohexane per minute or 672 cc per hour for a gas vapor flow rate of 2.46 liters per minute. Total consumption was about 1,480 cc for 2¼ hour carburizing runs. Delivery pressure is typically set at 11 psig. The injector is designed for upwards of 50 psi, and normally runs in the 35–42 psig range for automotive applications. Also, the injector can run up to 800 ms before reaching about 80% maximum duty cycle so that the 70 ms cycle is only about a 9% duty cycle. For purposes of this invention, an injector which can vary its pulse width of anywhere from about 5 milliseconds to 700 milliseconds at injection pressures of about 5 to 50 psig is believed acceptable. If necessary, larger and smaller injectors are commercially and readily available should there be substantial increases or decreases in flow requirements. The injector, being designed for automotive vehicular application has not developed any leaks, nor have the O-rings experienced softening or swelling when submerged in 100% cyclohexane for twelve months. Since the automotive 0-rings are providing sufficient service, no further investigation into the sealing capabilities of the fuel injector is planned.

Figure 10:
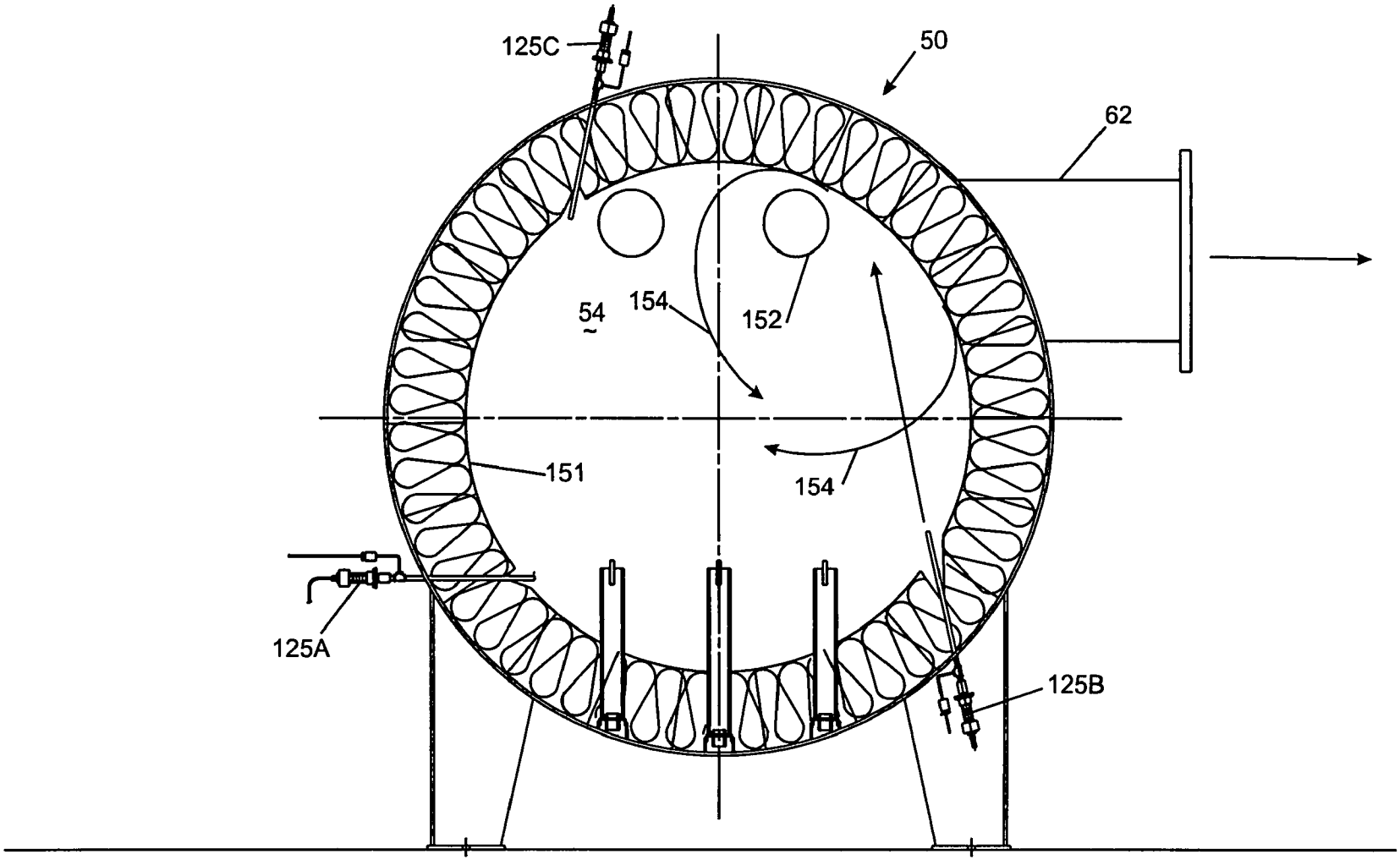
FIG. 10 is a cross-sectional view of a gas fired hot walled vacuum furnace modified to accommodate the liquid fuel injectors of the present invention.
Figures 11, 11A:
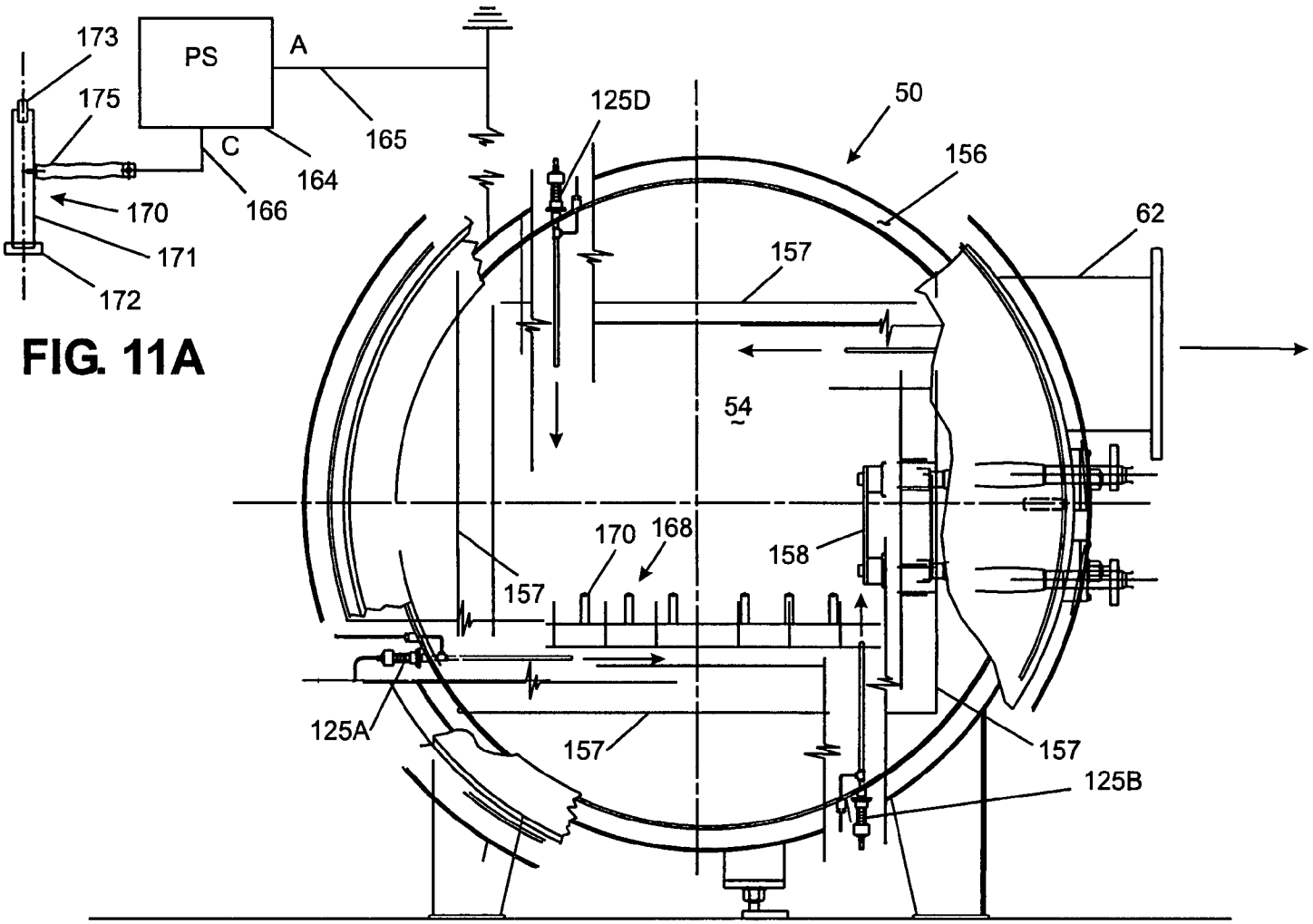
FIG. 11 is a cross-sectional view of a cold walled vacuum carburizing furnace modified to accommodate the liquid fuel injectors of the present invention.
FIG. 11A is a schematic depiction of a furnace construction detail for a vacuum ion carburizing furnace practicing the invention; and, FIG. 12 is a graph showing carburized case depth hardness readings at the root and pitch diameters of a gear tooth carburized in accordance with the vacuum carburizing concepts of the present invention.

Referring still to FIG. 9 and also as shown in FIGS. 10 and 11, vacuum furnace chamber 54 is provided with multiple fuel injectors, there being 4 fuel injectors designated 125A, 125B, 125C and 125D shown in FIG. 9. In FIG. 10, there are three fuel injectors 125A–125C angled in a desired configuration and in FIG. 11, there are deflecting radiation shields. With regard to the positioning of the injectors, it was originally felt that 4 or more injectors would be mounted tangentially with smaller furnaces being equipped with two injectors. The injectors would fire in a clockwise pattern or counter-clockwise and create a variation in the atmosphere for a given part and the atmosphere for the carburizing gas would move to the parts for carburizing. It is now strongly believed that the injectors should be mounted with their outlets above or below the load and strike a transparent target. The momentum of the pulse will then push or deflect or reflect the gas toward the load but the gas would be diffused. The transparent target can be the radiation shields of FIG. 11 or the round furnace wall of FIG. 10 which can produce a parabolic deflection back to the work as indicated by the flow arrows.

The prior art (excluding, of course, ion carburizing) has attempted to improve the flow of the carburizing gas over the workpieces by installing multiple gas inlet ports. The multiple gas inlet ports deliver a continuous flow of gas which is trying to find its way to the vacuum pump. In its effort to find the vacuum pump exit, carburizing gas, by coincidence, comes into contact with the load to be carburized. However, even with multiple gas inlet ports, the gas, in all probability, will tend to pass by certain parts or surfaces of certain parts more often than others so that the net result is a variation in case in the carburized load. Within conventional gas carburizing art, a circulation fan is typically installed for the purpose of mixing carrier gas and enriching gas uniformly and causing this mixed gas to pass as much of the load surface area as possible to improve on case penetration and overall uniformity. In a vacuum furnace, a fan is not possible since the amount of gas at typical vacuum furnace pressures of 10 torr is negligible. There is nothing to circulate. Also, fan motors do not operate in a vacuum due to arcing of the electrical windings.

Using multiple fuel injectors as disclosed in this invention can address this problem because the injector sequencing can be varied to create a higher degree of randomness or disorder. Therefore, due to the random nature of the variation in the injector sequencing pattern, those sections of the work which otherwise might have been deprived of carburizing gas due to the predictability of a given flow pattern, can now be exposed to the gas.

More particularly, the injector pattern for a given injector would repeatably fire for as short as 10 seconds and as long as 10 minutes before passing over to the next injector. Better yet, the injector would fire for 30 seconds to 5 minutes before passing over to the next injector, and better yet the injector would fire for 1 to 2 minutes before passing over to the next injector. The pattern for the first sequence would be 1, 2, 3, 4. For the second sequence, 1, 3, 2, 4. For the third sequence, the pattern could be 1, 4, 3, 2. Likewise, for the fourth sequence, the pattern could be 1, 2, 4, 3. The firing sequence is not limited to the patterns described, which are listed only for the purpose of explanation.

As a further extension to the creation of a random flow of gas throughout the work, the injector has the ability of varying its pulse width. The longer the pulse width, the greater the force of impact on the target. Changing the point of impact changes again the randomness of the initiation of the gas burst. Likewise, the short duration pulses may not at all even strike the target and therefore generate yet another propagation point of the gas. The injector pattern on low duration pulses tends to be soft and diffused. The injector pattern when striking a target with a very long pulse width creates a harsh reflection with rippling patterns of greater circumference than those of the shorter pulse.

Therefore, randomness or disorder in the delivery can be assured by not only changing the sequence for the firing of the injectors but also for the duration during which the injectors fire and before switching over to another injector in the firing order. For example, assume that an average 50 millisecond pulse is to be produced for a given injector every second. Injector 1 fires 5 milliseconds and does not strike the target for a period of 30 seconds. At the end of the 30 seconds, the injector fires at 95 milliseconds for 30 seconds. The average pulse width at the conclusion of 60 seconds is still 50 milliseconds per second so the correct amount of gas has been injected. For the next period of 30 seconds, the injector fires at 20 milliseconds followed by a 30 second period of 80 milliseconds. The third minute of operation of the injector could be simply 50 milliseconds. During this time period the gas does not reach the target and then reaches the target harshly. During the 50 millisecond pulse, the target is reached but not as harshly as that when the pulse width of the injector was at 80 milliseconds. Note that while this technique is in operation for injector 1, alternate patterns are about to happen on injectors 2, 3 and 4. At the end of 5 minutes, the total gas injected into the furnace is the same as if the injector was operating at steady state.

The controller can easily implement the variations described above once the operator sets a set flow point in the controller. The controller for the system creates the variations in flow and generates the random flow patterns. It is to be understood that while all of the metering valves and gauges shown in the furnace drawings visually depict manual type devices, the gauges are sending signals to a master controller such as the DataVac controller 77 or to a specific controller such as PID loop controller 69 and the controller in turn, is outputting command signal to actuators which control the valves or set the injection pulses. As is well known in the control art, the master controller can send the command signal directly to the actuator controlling a valve or the command signal can be sent to a dedicated controller which in turn, will generate the actuator output signal.

The liquid fuel injectors of the present invention overcome this problem and can be used with any hydrocarbon liquid form and not just with the cyclic hydrocarbons of the present invention. Basically, the liquid and thus the vaporized gas, is injected into the furnace chamber with a momentum which controls the flow of the gas through the vacuum exhaust. By changing the momentum during the carburizing process, the path that the carburizing gas takes can be varied in a manner to insure that all-parts and all part surfaces are exposed to carburizing gas flow and thus are uniformly carburized.

E. Furnace Construction/Insulation

FIG. 9 shows a conventional cold wall vacuum furnace with insulation 107 provided as boards fitted together as illustrated and secured to the interior of inner chamber frame or housing 149 by studs indicated generally by reference numeral 150. In the FIG. 9 embodiment, the fuel injectors 125A–125D are mounted tangentially and will produce a clockwise or counterclockwise flow. For reasons discussed above, this is not especially preferred. However, by varying injection timing and pulse width, the gas momentum can be varied to achieve better dispersion of the gas through the work than is possible with multiple gas nozzles.

FIG. 10 is a hot wall furnace and insulation 58 is of a blanket type. More particularly, the insulation is a vacuum-form ceramic fiber insulation of a relatively high density (10–15 lbs/fl$^3$). The surface of the insulation is sprayed with a conventional silica sand mixture, i.e., Kaowool rigidizer, which makes it hard and rigid. The insulation is formed into pre-shaped blocks individually secured to the casing by studs (not shown) fitted together like pieces of a jig-saw puzzle into a tight compressive contact with one another which, when sprayed with the rigidizer, reduces gas infiltration therethrough and resists erosion during gas quenching (if the furnace is equipped with a gas quench). Vacuum furnace 50 illustrated in FIG. 10 is also provided with gas fired radiant heating tubes schematically indicated by reference numeral 152. In the furnace of FIG. 10, three circumferentially spaced injectors 125A–125C are orientated as shown so that the gas vapor will impact rigidizing skin 151 and assume the flow direction indicated by arrows designated by reference numeral 154 during one part of the injection cycle. It is to be noted that the discussion of vacuum furnace application centers about the workpieces being placed loose in trays moved into and out of furnace chamber 54 which is the procedure typically followed by commercial heat treaters. For captive applications which involve carburizing one particular workpiece, the workpiece may be fixtured and set in a fixed position in furnace chamber 54. For those applications the diffusion pattern discussed above can be set to be especially effective. However, it may be possible to place lances with shaped outlets to directly impinge the entire surface area. In this regard, the lance(s) could be automated to telescope between fixtured workpieces to assure a specific position.

FIG. 11 illustrates a cold wall design furnace wherein a water jacket 156 exists between inner and outer furnace casings. In a cold wall vacuum furnace, multiple radiation shields 157 typically provide a box-like enclosure or inner liner in which the work tray is placed. Positioned within the inner liner are electric heating elements 158. Heat from heating elements 158 is radiated by radiation shields 157 to the work. The radiation shields or inner liner are welded together into the box like inner liner construction but are not vacuum tight.

In the discussion above, it was mentioned that iron acted as a catalyst speeding the cracking reaction of the cyclic hydrocarbon gases. Conceptually, it is desired that vacuum furnace 50, specifically the vacuum furnace structure defining furnace chamber 54, be inert or transparent with respect to its ability to cause a catalytic reaction with the cyclic hydrocarbon carburizing gases. It has been determined that the cyclic hydrocarbons, particularly the 5 and 6 carbon sided rings of the preferred embodiment, do not form any reaction with graphite. The furnace illustrated in FIG. 10 has graphite insulation with a graphite foil cover. No carbon drop-out was observed on the graphite board. The heating elements were graphite and were bright in appearance following the carburizing cycles. In fact, graphite boards that have been placed in the furnace chamber after the end of a carburizing cycle, have been scrubbed with a wet white paper towel with virtually low or no carbon pick-up. Typically, just touching a graphite board in a carburizing furnace using conventional carburizing gases leaves carbon on one's fingers.

Ceramic insulation, however, made from aluminum and silica, appears to breakdown the gas. In accordance with the invention, it is preferred that when using aluminum and silica insulation in the vacuum furnace, the insulation should normally be covered either by a graphite paint which can be painted, rolled or sprayed, or by a graphite foil covering the aluminum and silica ceramics. At the same time, it was discovered that aluminum silica ceramic insulation, over time, acquired a graphite-type or graphite like coating which made the insulation somewhat transparent to the gas, resulting in little carbon drop-out. Accordingly, it may be possible to purposely develop a graphite type or protective coating on an alumina and silica ceramic furnace insulation by running the naphthene in the furnace for a couple of days. However, tests of durability of the coating have not been run as of the date of this invention. The graphite coating does appear to be uniformly deposited over all the insulation in the furnace. It is uncertain whether the graphite coating can withstand the fan flows in the furnace chamber when quenching at high pressures with inert gases. For the radiant tube application, conventional high alloy radiant tubes may be used (protective graphite type seal formed), however, silicon carbide tubes now being developed for high temperature applications of radiant tubes are completely transparent to the carburizing gas and can be employed. It must be noted that hot wall gas fired vacuum furnaces do not have the concern over carbon deposition that electric cold wall furnaces have. Carbon deposits in cold wall electric furnaces can ground the heating elements leading to an inoperable furnace. So long as tar is not formed in the hot wall gas fired furnace design, carbon deposits are not of serious concern. Also, the cylindrical configuration of the furnace casing with interior insulation allows for better temperature uniformity throughout the furnace chamber. Finally, cast alloy radiant tubes were used in the prototype furnace. Carbon dust was found over the tubes, as expected but the dust did not have any effect on the carburizing process. Accordingly, when used herein, the terminology of "transparent" or "substantially inert" with respect to the cracking reaction which can occur with the naphthene carburizing gas, means or includes materials that otherwise would react with the naphthene in their native form, but which have acquired a graphitic like coating which tends to make them inert.

With respect to the radiation shield inner lining 157 of the cold wall vacuum furnace, it was found that the molybdenum liners were somewhat transparent to the gas. Transparency is believed established because the liners were clean after carburizing. The molybdenum liners had no iron. It is believed that molybdenum radiation shields should not have an iron content greater than 5% when used with the invention. It has also been discovered that moly-nickel alloy with less than 5% Fe balance appears transparent to the naphthene gas despite the presence of nickel. This alloy has traditionally not been used as a radiation shield, but it is available in thin section suitable for radiation shield design. Please note that the steel casing surrounding the radiation shield in the cold wall furnace is at a temperature as high as 400° F. and depends on the amount of insulation used and operating temperature. The cyclic hydrocarbon gases are not reactive at this temperature. Thus, no precaution is needed for the cold wall vacuum furnace other than the selection of the material for the radiation shields and the use of graphite heating elements instead of metal resistance heating elements.

Some preferred modifications are required when the invention is used in a vacuum ion (glow discharge) furnace and this is shown in FIG. 11A which conceptually illustrates a modification to vacuum furnace 50 of FIG. 11 by applying a glow discharge, ion power supply 164. Power supply 64 ionizes the carburizing gas by creating electrical potential between anode 165 which is ground established by the furnace casing and cathode 166 which is the workpiece. Electrical contact for the cathode is established from the work which as noted lie on a tray which in turn rests on a furnace hearth designated by reference arrow 168 in FIG. 11. Hearth 168 is comprised of a plurality of hearth supports, one of which, hearth support 170, is connected to power supply 164 as shown in FIG. 11A. Hearth support 170 comprises a graphite post 171 which is journaled at its bottom in a ceramic insulator 172 which in turn is vacuum sealed to the inner furnace casing. At the top of post 171 is a silicon carbide rail 173 which spans several posts and serves as an electrically conductive support for the workpiece tray. Attached to post 171 is an electrical cable (copper) 175, preferably within a graphite coated shield (not shown) which in turn is connected to a feed through (not shown) which extends through (vacuum tight) the inner and outer furnace casings forming water jacket 156. Alternatively, copper cable 175 could be connected to post 171 in the vicinity of insulator 172 where the water jacket reduces temperature. The feed through is at the cold wall so no gas protection substance is needed. However, the rest of the hearth is electrically conductive but essentially transparent to causing catalytic cracking reaction with the carburizing gas. Reference can be had to U.S. Pat. No. 5,127,967 to Verhoff et al. entitled "Ion Carburizing" issued Jul. 7, 1992 incorporated herein by reference for its description of power supply 164 and hearth connections thereto which will not be discussed further.

It is also noted that lance 132 for fuel injectors 125 is made out of stainless steel and have remained repeatedly clean and bright during operation. Some cracking of the hydrocarbon in the lance is possible because of the iron content in the stainless steel. However, it is believed that the speed of the vaporized fuel pulse through the lance minimizes cracking of the naphthene in the lance.

F. Example

Figure 12:
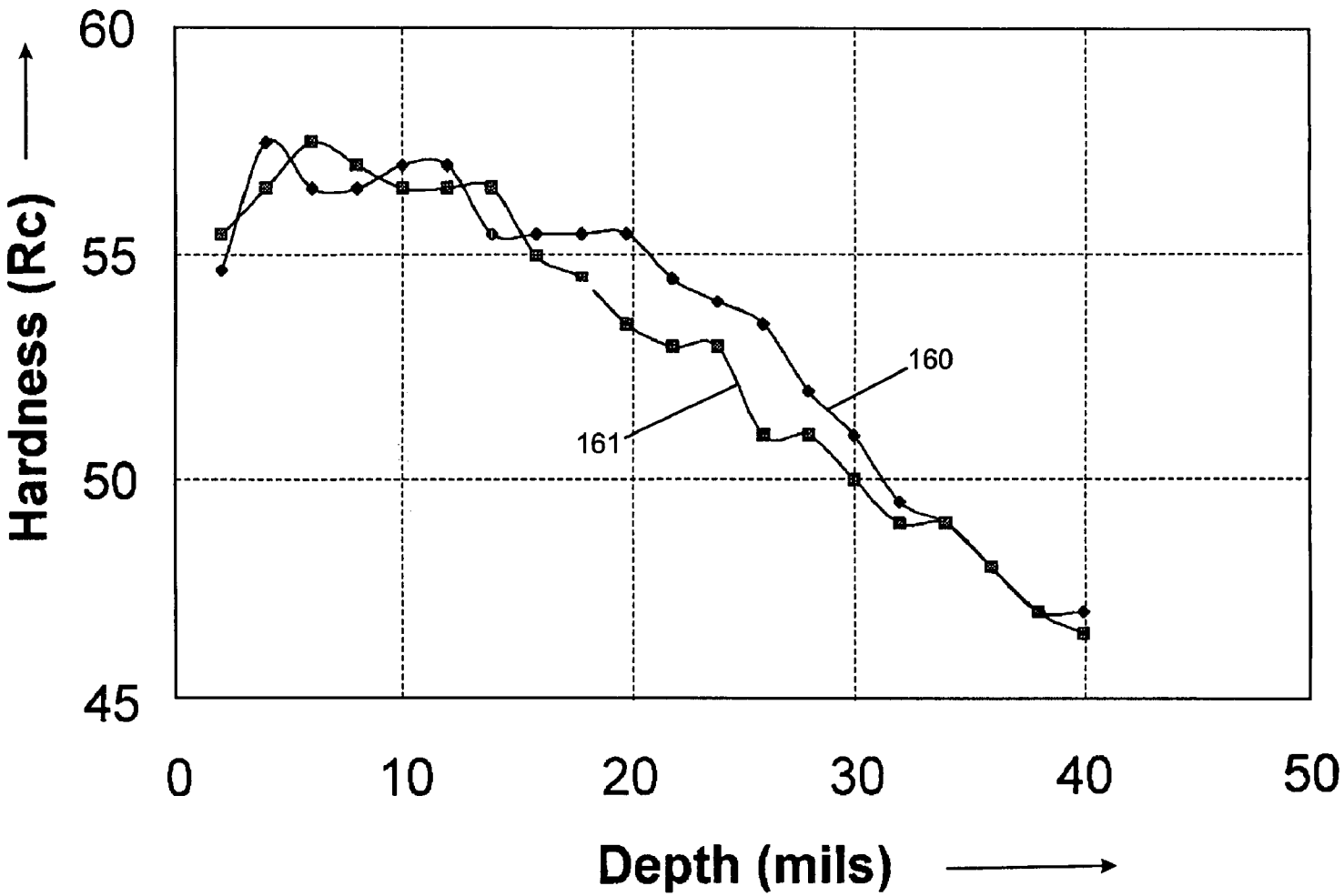

There are a number of carburizing results which have been conducted at different temperatures and pressures with and without different hydrogen mixtures that could be included in this description of the invention. However, the graph shown in FIG. 12 was obtained on a 5130 transmission helical gear having a 1 7/16" O.D. (outside diameter) and a 11/16" ID. (inside diameter) and a height of about ¾". Gears of this type are considered to have a complex or convoluted geometry and it is especially difficult to obtain uniform carburizing results at the pitch and root diameters of the gear. FIG. 12 plots the hardness and case depth for the carburized gear at its pitch diameter indicated by the trace passing through triangles designatei by reference numeral 160 and at its root diameter by the trace passing through squares designated by reference numeral 161. Variation and hardness between pitch and root diameter is very close. As a point of reference, a typical root-to-pitch hardness difference of 65% is typically obtained for atmospheric gas carburizing and this variation or difference can be reduced to about 90% with ion carburizing. The graph depicted in FIG. 12 shows a differential in hardness of about 93.5%.

The carburizing tests were conducted in assignee's hot wall vacuum furnace such as shown in FIG. 10. This vacuum furnace, however, had only one fuel injector 125 running. Only two gears were available for testing so the work tray was also loaded with 8620 test bars to provide a surface area greater load. The duty cycle for the fuel injector was fixed. That is, the injector was pulsed on and off at the same frequency throughout the cycle. The flow was not reversed nor was the timing of the firing changed. Thus, no attempt was made to provide improved gas flow about the work so that the improved results can be attributed only to the carburizing gas.

The furnace chamber with the work was heated to 1700° F. under hard vacuum and allowed to soak at 1700° F. for about 1 hour 15 minutes. The carburizing cycle was started using methylcyclohexane at 9.5 torr and lasted for exactly 55 minutes. The flow rate (vapor flow rate) of methylcyclohexane was 2.44 liters/minute. (Injector pulse was 70 milliseconds with 11 psig blanked pressure. Liquid usage was 610 cc.) Hydrogen at a rate of 0.5 l/m was flowed with the methylcyclohexane. After 55 minutes, the EVAC valve was opened and the choker valve was closed so that the vacuum pump was allowed to remove all furnace atmosphere. Vacuum levels after 5 minutes were down to about 75 microns which is typical for this furnace.

A diffuse segment was allowed to progress at the 1700° F. for exactly 50 minutes. At the completion of the diffuse segment, the EVAC valve was closed and the furnace was back-filled and the cooling fan turned on at 1 bar or 0 psig. The furnace was cooled under nitrogen at 3 psig to 180° F.

Because the vacuum furnace did not have a liquid quench or high pressure gas quench, parts were sent to a commercial heat treater who case hardened the parts with a Surface Combustion multi-chamber vacuum furnace having an oil quench. The parts were heated to austenitic temperature of 1550° F. and allowed to soak at this temperature for as short a time as possible, i.e., 45 to 60 minutes. Some diffusion can occur at this temperature but it is believed negligible. The parts were then oil quenched in a vacuum to prevent any oxide formation or inclusion. Following quench, the parts were tempered at 250° F. The parts were then cut, polished and micro-hardness readings taken, as is conventional to produce the graphs depicted in FIG. 12.

In addition to the test results for the gear graphed in FIG. 12, a number of tests were run with the carburizing gases of the preferred embodiment on standard sample 8620 test bars. Data from some of these tests is collected and tabulated below in Table 2.

TABLE 2

8620 SAMPLE CARBON BAR TESTS

| P | T | Ti | Liquid Used | HC Flow Target Flow | Actual Flow | $H_2$ Flow | Eff. Case | Total case | Surface % C |
|---|---|---|---|---|---|---|---|---|---|
| 9.5 | 1700 | 2:15 | 1435 | 2.50 l/m | 2.34 l/m | 2.0 | 0.030" | 0.041" | 1.32% |
| 2.0 | 1600 | 3:00 | 1942 | 2.50 l/m | 2.37 l/m | 2.0 | 0.022" | 0.032" | 1.04% |
| 5.0 | 1600 | 3:00 | 1920 | 2.50 l/m | 2.34 l/m | 2.0 | 0.022" | 0.033" | 1.06% |
| 9.5 | 1600 | 3:00 | 2000 | 2.50 l/m | 2.44 l/m | 2.0 | 0.022" | 0.033" | 1.06% |
| 2.0 | 1700 | 2:15 | 1390 | 2.0 l/m | 2.26 l/mn | 2.0 | 0.030" | 0.042" | 1.27% |
| 5.0 | 1700 | 2:15 | 1460 | 2.50 l/m | 2.38 l/m | 2.0 | 0.028" | 0.040" | 1.31% |
| 9.5 | 1700 | 2:15 | 1430 | 2.50 l/m | 2.33 l/m | 2.0 | 0.031" | 0.042" | 1.32% |
| 2.0 | 1800 | 1:15 | 800 | 2.50 l/m | 2.34 l/m | 2.0 | 0.034" | 0.045" | 1.35% |
| 9.5 | 1800 | 1:15 | 770 | 2.50 l/ | 2.26 l/m | 2.0 | 0.036" | 0.048" | 1.31% |
| 5.0 | 1800 | 1:15 | 800 | 2.50 l/m | 2.34 l/m | 2.0 | 0.035" | 0.047" | 1.30% |
| 20 | 1800 | 1:15 | 815 | 2.50 l/m | 2.39 l/m | 2.0 | 0.031" | 0.043" | 1.31% |

Where:
"P" is pressure is in torr.
"T" is carburizing temperature in degrees Fahrenheit.
"Ti" is cycle time in hours followed by minutes.
"Liquid" is the total amount of HC used in the carburizing cycle in cc of liquid - all tests used cyclohexane as HC.
"$H_2$ Flow" is the gas flow rate of hydrogen in liters per minute.
"HC Flow" is the HC flow converted to liters per minute. In all tests cited above, the target flow rate was 2.50 liters/minute.
"Eff. Case" is the effective case depth in inches.
"Total Case" is the total case depth in inches.
"Surface % C" is the amount of carbon absorbed on the surface of the workpiece.

Generally Table 2 above shows that consistent repeatable results at full saturation are obtained with the cyclic hydrocarbon gas of the preferred embodiment.

The invention has been explained with reference to vacuum carburizing per se. Experiments have not been undertaken with respect to carbonitriding. It is believed that the invention will work as described with the addition of ammonia which will serve as a source of hydrogen as well as providing monatomic nitrogen. However, within the hydrocarbon field are ring hydrocarbons which contain monatomic nitrogen. These hydrocarbons are classified within the definition of cyclic hydrocarbons and can be a source for not only providing the carbon for carburizing as in the case of the cyclohexane preferred embodiment but also for providing monatomic nitrogen for carbonitriding. However, as of the date of this patent, tests have not been undertaken and specific cyclic hydrocarbons have not been selected for investigation.

Within the field of carbonitriding using ammonia, typically ammonia is used at temperatures in the range of 900° F. to 1100° F. for the process described as ferritic nitrocarburizing and at higher temperatures in the range of 1525° F. to 1640° F. described as carbonitriding. Both of the aforementioned processes typically use ammonia as the source of nitrogen.

Within the scope of this invention, it is possible to supply a cyclic hydrocarbon for the purpose of supplying both activated carbon and monatomic nitrogen simultaneously from one hydrocarbon compound. There are cyclic compounds available with at least one carbon in the ring replaced by one "N" in monatomic form. This compound at such time as ring rupture, fracture or cracking would release carbon for the purpose of placing carbon in solution with the iron and likewise release monatomic nitrogen for placing nitrogen in solution with the iron at the same time.

In addition or alternately, there are cyclic hydrocarbons that have NH and $NH_2$ components attached to any of the carbons in the ring. Many of these commercially available compounds have more than one NH or $NH_2$ group and may have these groups with or without the methyl or ethyl groups. it is also possible to select from the group that have $NHCH_3$ groups attached. It is therefore possible to supply by choice of compounds different carbon to nitrogen ratios in the case altering gas. For example, cyclic hydrocarbons such as aniline or methylpiperidine or piperidine, or speridine are some hydrocarbons that may be suitable. There are also saturated hydrocarbons such as cyclohexylamine also called aminocyclohexane or cyclohexanamine which have suitable boiling and freeze points that are available in liquid form and technically would be suitable to operate with liquid injection systems described herein.

It is also recognized that many of these compounds are considered environmentally unfriendly. However, it is believed that upon contact with the iron workpiece, the hydrocarbon will likewise decompose by catalytic reaction (as with the carburizing hydrocarbons of the present invention) on the steel workpiece and leave the furnace as methane or $N_2$. Experimentation is required to prove out the theory suggested, but when compared to traditional atmosphere carbonitriding where traditional furnaces are typically leaking gases to the environment and work place, it is foreseen that vacuum technology keeps these types of compounds safely away from both workers and the environment. Should it be determined that some small percentages of such compounds remain, provisions could be added to either catalytically destruct such materials or oxidize such materials outside the furnace vacuum chamber.

The invention has been described with reference to preferred and alternative embodiments. Obviously, alterations and modifications will occur to those skilled in the art upon reading and understanding the detailed description of the invention set forth above. It should be clear to those skilled in the art that the invention will work if conventional carburizing gases, say in liquid form, are blended with the naphthenes or cyclic hydrocarbons and the blended mixture metered into the furnace. The added conventional carburizing gases will then carburize as is conventionally known and the naphthenes or cyclic hydrocarbons disclosed herein will carburize as disclosed herein. Of course, to realize the advantages of the invention, the "blend" would contain naphthene as a major component thereof, for example, 50% or more of the blend would be formulated from naphthene hydrocarbons. It is intended to include all such alterations and modifications insofar as they come within the scope of the present invention.

We claim:

1. A vacuum furnace for carburizing ferrous workpieces therein comprising:

a furnace casing defining a furnace chamber therein closed at one end by a vacuum sealable door; a heater within the furnace chamber;

a vacuum pump in fluid communication with the furnace chamber;

an injector configured to deliver pulses of liquid carburizing hydrocarbon into the furnace chamber, the injector being vacuum sealed to an opening in the casing; the injector having an inlet in fluid communication with a source of liquid carburizing hydrocarbon under pressure in relation to the vacuum furnace, and an outlet in fluid communication with the furnace chamber; and, a controller for controlling i) the heater for regulating the temperature of the workpiece in the furnace chamber, ii) the vacuum pump for regulating the pressure of the furnace chamber, and iii) the injector for regulating the pulsing of the liquid carburizing hydrocarbon.

2. The furnace of claim 1, further including a plurality of the injectors spaced about the furnace casing.

3. The furnace of claim 2, wherein the injectors are circumferentially spaced about the furnace casing.

4. The furnace of claim 1, wherein the injector has an expansion chamber upstream of the injector outlet.

5. The furnace of claim 1, wherein the injector is fixed or variably set for pulsed time and pulse width during a time when the liquid carburizing hydrocarbon is metered into the furnace chamber.

6. The furnace of claim 1, wherein the injector is adapted to pulse discrete quantities of the liquid carburizing hydrocarbon into the furnace at one or more of set or variable: time intervals, pulse widths and frequencies.

7. The furnace of claim 2, wherein the injectors are in fluid communication with the furnace chamber at set spaced distances about the furnace, and wherein each injector is adapted to inject the liquid carburizing hydrocarbon at a set time in relation to other injectors.

8. The furnace of claim 1, wherein the injector is configured to inject liquid carburizing hydrocarbon selected from the group consisting of cyclohexane, including variations thereof such as methylcyclohexane, ethyl cyclohexane, dimethyl cyclohexane, trimethyl cyclohexane, and cyclopentane, including variations thereof such as methylcyclopentane, ethyl cyclopentane.

9. A vacuum furnace for carburizing ferrous workpieces therein comprising:

a furnace casing defining a furnace chamber therein closed at one end by a vacuum sealable door; a heater within the furnace chamber;

a vacuum pump in fluid communication with the furnace chamber;

an injector of the pulse operating type vacuum sealed to an opening in the casing; the injector having an inlet in fluid communication with a source of liquid carburizing hydrocarbon under pressure in relation to the vacuum furnace and an outlet in fluid communication with the furnace chamber;

a controller for controlling i) the heater for regulating the temperature of the workpiece in the furnace chamber, ii) the vacuum pump for regulating the pressure of the furnace chamber, and iii) the injector for regulating the pulsing of the liquid carburizing hydrocarbon; and, further including at least one gas metered inlet in fluid communication with the furnace chamber and a source of hydrogen gas; the controller regulating the metering of hydrogen through the gas metered inlet while the injector is pulsing the liquid carburizing hydrocarbon into the furnace chamber.

10. The furnace of claim 9, wherein a plurality of hydrogen gas metered inlets are in fluid communication with the furnace chamber.

11. The furnace of claim 9, further including a methane analyzer for determining the content of methane in the furnace chamber, the controller regulating the injector as a function of the methane detected by the analyzer.

12. The furnace of claim 11, wherein the methane analyzer is an NDIR sensor.

13. The furnace of claim 9, wherein each gas metered inlet is connected to an associated expansion chamber.

14. The furnace of claim 1, further including a deflecting shield generally transparent to the liquid carburizing hydrocarbon adjacent the injector outlet.

15. The furnace of claim 14, wherein the deflecting shield is adapted to redirect the hydrocarbon to the workpiece.

16. The furnace of claim 14, wherein the deflecting shield comprises, or is coated with graphite or ceramics, which have been exposed to hydrocarbon gas to develop a graphite type surface, or molybdenum alloys having an iron content less than about 5%.

17. The furnace of claim 1, having an inner casing sealingly surrounding the furnace casing to define a cooling chamber therebetween whereby the furnace is of a cold wall type.

18. The furnace of claim 17, wherein the inner casing has a coating comprising one or more of insulating board, insulation foil, or having or containing graphite, whereby reaction of the liquid carburizing hydrocarbon and the inner casing is minimized.

19. The furnace of claim 1, further including a cathode extending into the furnace chamber, an anode extending into the furnace chamber and a power supply therebetween, the anode and the cathode having carburizing hydrocarbon transparent exposed surfaces within the furnace.

20. The furnace of claim 1, wherein the furnace casing has insulation applied thereto whereby the furnace is of a hot wall design.

21. The furnace of claim 20, wherein the furnace casing has a coating over an interior of the furnace casing which is substantially graphite.

22. A vacuum furnace for carburizing ferrous workpieces therein comprising:

a furnace casing defining a furnace chamber therein closed at one end by a vacuum sealable door; a heater within the furnace chamber;

a vacuum pump in fluid communication with the furnace chamber;

an injector of the pulse operating type vacuum sealed to an opening in the casing, the injector having an inlet in fluid communication with a source of liquid carburizing hydrocarbon under pressure in relation to the vacuum furnace and an outlet in fluid communication with the furnace chamber;

a device for adding a source of monatomic nitrogen into the furnace chamber; and, a controller for controlling i) the heater for regulating the temperature of the workpiece in the furnace chamber, ii) the vacuum pump for regulating the pressure of the furnace chamber, and iii) the injector for regulating the pulsing of the liquid carburizing hydrocarbon.

23. The vacuum furnace of claim 22, wherein the injector is configured to pulse monatomic nitrogen comprising at least one of ammonia or at least one ring hydrocarbon which contains monatomic nitrogen.

24. The vacuum furnace of claim 22, wherein the injector is configured to pulse monatomic nitrogen comprising at least one cyclic hydrocarbon having at least one NH, $NH_2$, or $NHCH_3$ groups attached to any of the carbons in the ring.

25. The vacuum furnace of claim 22, wherein the injector is configured to pulse monatomic nitrogen comprising at least one of cyclic hydrocarbons including aniline, methylpiperidine, piperidine, speridine, cyclohexylamine, aminocyclohexane and cyclohexanamine.

26. The furnace of claim 22, further including a plurality of the injectors spaced about the furnace casing.

27. The furnace of claim 26, wherein the injectors are circumferentially spaced about the furnace casing.

28. The furnace of claim 22, wherein the injector has an expansion chamber upstream of the injector outlet.

29. The furnace of claim 22, wherein the injector is fixed or variably set for pulsed time and pulse width during a time when the liquid carburizing hydrocarbon is metered into the furnace chamber.

30. The furnace of claim 22, wherein the injector is adapted to pulse discrete quantities of the liquid carburizing hydrocarbon into the furnace at one or more of set or variable: time intervals, pulse widths and frequencies.

31. The furnace of claim 26, wherein the injectors are in fluid communication with the furnace chamber at set spaced distances about the furnace, and wherein each injector is adapted to inject the liquid carburizing hydrocarbon at a set time in relation to other injectors.

32. The furnace of claim 22, wherein the injector injects the liquid carburizing hydrocarbon selected from the group consisting of cyclohexane, including variations thereof such as methylcyclohexane, ethyl cyclohexane, dimethyl cyclohexane, trimethyl cyclohexane, and cyclopentane, including variations thereof such as methylcyclopentane, ethyl cyclopentane.

33. The furnace of claim 22, further including at least one gas metered inlet in fluid communication with the furnace chamber and a source of hydrogen gas; the controller regulating the metering of hydrogen through the gas metered inlet while the injector is pulsing the liquid carburizing hydrocarbon into the furnace chamber.

34. The furnace of claim 33, wherein a plurality of hydrogen gas metered inlets are in fluid communication with the furnace chamber.

35. The furnace of claim 33, further including a methane analyzer for determining the content of methane in the furnace chamber, the controller regulating the injector as a function of the methane detected by the analyzer.

36. The furnace of claim 35, wherein the methane analyzer is an NDIR sensor.

37. The furnace of claim 33, wherein each gas metered inlet is connected to an associated expansion chamber.

38. The furnace of claim 22, further including a deflecting shield generally transparent to the liquid carburizing hydrocarbon adjacent the injector outlet.

39. The furnace of claim 38, wherein the deflecting shield is adapted to redirect the hydrocarbon to the workpiece.

40. The furnace of claim 38, wherein the deflecting shield comprises, or is coated with graphite or ceramics, which have been exposed to hydrocarbon gas to develop a graphite type surface, or molybdenum alloys having an iron content less than about 5%.

41. The furnace of claim 22, having an inner casing sealingly surrounding the furnace casing to define a cooling chamber therebetween whereby the furnace is of a cold wall type.

42. The furnace of claim 41, wherein the inner casing has a coating comprising one or more of insulating board, insulation foil, or having or containing graphite, whereby reaction of the liquid carburizing hydrocarbon and the inner casing is minimized.

43. The furnace of claim 22, further including a cathode extending into the furnace chamber, an anode extending into the furnace chamber and a power supply therebetween, the anode and the cathode having carburizing hydrocarbon transparent exposed surfaces within the furnace.

44. The furnace of claim 22, wherein the furnace casing has insulation applied thereto whereby the furnace is of a hot wall design.

45. The furnace of claim 44, wherein the furnace casing has a coating over an interior of the furnace casing which is substantially graphite.

* * * * *